US011094247B2

(12) United States Patent
Lin et al.

(10) Patent No.: US 11,094,247 B2
(45) Date of Patent: Aug. 17, 2021

(54) DRIVING APPARATUS OF LIGHT EMITTING DIODE DISPLAY DEVICE FOR COMPENSATING EMISSION LUMINANCE GAP

(71) Applicant: Novatek Microelectronics Corp., Hsinchu (TW)

(72) Inventors: Kun-Yueh Lin, Hsinchu (TW); Hui-Hung Chang, Keelung (TW); Chien-Yu Chen, Hsinchu County (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 16/822,031

(22) Filed: Mar. 18, 2020

(65) Prior Publication Data

US 2020/0219437 A1 Jul. 9, 2020

Related U.S. Application Data

(63) Continuation of application No. 15/900,809, filed on Feb. 21, 2018, now Pat. No. 10,629,114.

(60) Provisional application No. 62/585,543, filed on Nov. 14, 2017, provisional application No. 62/461,766, filed on Feb. 21, 2017.

(51) Int. Cl.
*G09G 3/32* (2016.01)
*G09G 3/3233* (2016.01)

(52) U.S. Cl.
CPC ..... *G09G 3/32* (2013.01); *G09G 3/3233* (2013.01); *G09G 2300/0819* (2013.01);
(Continued)

(58) Field of Classification Search
CPC ..... G09G 3/32; G09G 3/3233; G09G 2300/0819; G09G 2300/0842;
(Continued)

(56) References Cited

U.S. PATENT DOCUMENTS

2007/0013623 A1 1/2007 Kimura et al.
2007/0080905 A1 4/2007 Takahara
(Continued)

FOREIGN PATENT DOCUMENTS

CN 1897091 1/2007
CN 102063861 5/2011
(Continued)

OTHER PUBLICATIONS

Office Action of China Counterpart Application, dated Feb. 22, 2021, pp. 1-9.
(Continued)

*Primary Examiner* — Lisa S Landis
(74) *Attorney, Agent, or Firm* — JCIPRNET

(57) ABSTRACT

A driving apparatus of a light emitting diode (LED) display device is provided. The driving apparatus includes a timing control circuit. The timing control circuit outputs a plurality of driving control signals to a gate driving circuit on an LED display panel of the LED display device. Wherein, the plurality of driving control signals includes a first driving control signal and a second driving control signal, and the pulse width of the first driving control signal in a first horizontal line period is different from the pulse width of a second driving control signal in a second horizontal line period preceding to the first horizontal line period.

11 Claims, 23 Drawing Sheets

(52) U.S. Cl.
CPC ..... *G09G 2300/0842* (2013.01); *G09G 2300/0861* (2013.01); *G09G 2310/0216* (2013.01); *G09G 2310/06* (2013.01); *G09G 2310/061* (2013.01); *G09G 2310/08* (2013.01); *G09G 2320/045* (2013.01); *G09G 2340/16* (2013.01)

(58) Field of Classification Search
CPC ... G09G 2300/0861; G09G 2310/0216; G09G 2310/06; G09G 2310/061; G09G 2310/08; G09G 2320/045; G09G 2320/16
See application file for complete search history.

(56) References Cited

U.S. PATENT DOCUMENTS

| | | | | |
|---|---|---|---|---|
| 2008/0018640 | A1* | 1/2008 | Tada ..... | G09G 3/3233 345/212 |
| 2008/0174612 | A1 | 7/2008 | Someya et al. | |
| 2010/0013826 | A1 | 1/2010 | Kimura et al. | |
| 2011/0115835 | A1 | 5/2011 | Lee | |
| 2017/0309219 | A1* | 10/2017 | Kong ..... | G09G 3/2003 |

FOREIGN PATENT DOCUMENTS

| | | |
|---|---|---|
| CN | 105702213 | 6/2016 |
| KR | 100812000 | 3/2008 |
| TW | I258113 | 7/2006 |
| TW | I342547 | 5/2011 |

OTHER PUBLICATIONS

Wang et al.,"Self-turn-off pulse-width modulation for OLED gray-scale controlling", Journal of Optoelectronics Laser, vol. 21, No. 5, May 2010, with English abstract, pp. 1-4.
Fu et al.,"Flexible Control of OLED Gray Scale Using FPGA", Chinese Journal of Liquid Crystals and Displays, vol. 21, No. 3, Jun. 2006, with English abstract, pp. 1-5.

* cited by examiner

DRIVING APPARATUS OF LIGHT EMITTING DIODE DISPLAY DEVICE FOR COMPENSATING EMISSION LUMINANCE GAP

CROSS-REFERENCE TO RELATED APPLICATION

This application is a continuation application of and claims the priority benefit of a prior application Ser. No. 15/900,809, filed on Feb. 21, 2018. The prior application Ser. No. 15/900,809 claims the priority benefits of U.S. provisional application Ser. No. 62/461,766, filed on Feb. 21, 2017 and U.S. provisional application Ser. No. 62/585,543, filed on Nov. 14, 2017. The entirety of each of the above-mentioned patent applications is hereby incorporated by reference herein and made a part of this specification.

BACKGROUND

Field of the Invention

The invention is related to a driving apparatus and more particularly, to a driving apparatus for eliminating a gap between ideal luminance and actual luminance under image change and a light emitting diode display device using the driving apparatus.

Description of Related Art

FIG. 1 illustrates a circuit block diagram of an organic light emitting diode (OLED) display device 100. The OLED display device includes an OLED display panel 110 and a driving apparatus 120. The OLED display panel 110 may be an active matrix organic light emitting diode (AMOLED) display panel. Alternatively, an active matrix LED display panel such as a micro LED display panel can be in place of the OLED display panel 110. The OLED display panel 110 includes a gate driving circuit 111 (referred to a gate on array (GOA) circuit in FIG. 1) and an OLED pixel array 112 having a plurality of OLED pixel circuits 112*p*. The OLED pixel array 112 has M horizontal lines (or, horizontal display lines), which means M rows of pixel circuits.

The driving apparatus 120 may provide signals, such as a start pulse signal FLM, gate clock signals CLK1 to CLKn with different phases, initialization clock signals INT1 to INTn with different phases, and emission clock signals EM_CLK1 to EM_CLKn with different phases, to the gate driving circuit 111 (or referred to as a GOA circuit). The gate driving circuit 111 may generate a plurality of gate scan signals $SCAN_1$ to $SCAN_M$ to the OLED display panel 110 according to the start pulse signal FLM and the gate clock signals CLK1 to CLKn of the driving apparatus 120. The gate driving circuit 111 may generate a plurality of initialization scan signals $INIT_1$ to $INIT_M$ to the OLED display panel 110 according to the start pulse signal FLM and the initialization clock signals INT1 to INTn of the driving apparatus 120. The gate driving circuit 111 may generate a plurality of emission scan signals $EM_1$ to $EM_M$ to the OLED display panel 110 according to the start pulse signal FLM and the emission clock signals EM_CLK1 to EM_CLKn of the driving apparatus 120. The gate scan signals $SCAN_1$ to $SCAN_M$, the initialization scan signals $INIT_1$ to $INIT_M$, and emission scan signals $EM_1$ to $EM_M$ can be generated by a shift register circuit in the gate driving circuit 111.

On the other hand, the driving apparatus 120 provides data voltages (i.e., pixel voltages) Data1 to DataX corresponding to a plurality of output channels of the driving apparatus 120, a system supply voltage VDD, a reference voltage VSS, and an initialization voltage V_INT to the OLED pixel array 112 of the OLED display panel 110.

FIG. 2A is a schematic circuit block diagram of an exemaplary AMOLED (abbreviated to OLED hereinafter) pixel circuit 112*a* depicted in FIG. 1. The OLED pixel circuit 112*a* of FIG. 2A may be used as the OLED pixel circuits 112*p* in FIG. 1, and includes an OLED 201, a pixel driving circuit formed by 6 p-channel type (p-type) thin film transistors (TFTs) T1-T6, and at least one storage capacitor 202. The p-type TFTs (pixel driving circuit) illustrated in FIG. 2A are controlled by driving control signals, including the gate scan signal $SCAN_i$ among the gate scan signals $SCAN_1$ to $SCAN_M$, the initialization scan signal $INIT_i$ among the initialization scan signals $INIT_i$ to $INIT_M$, and the emission scan signal $EM_i$ among the emission scan signals $EM_1$ to $EM_M$, wherein i denotes $i^{th}$ horizontal line (or, horizontal display line), which means a row of pixel circuits. Based on the control of the driving control signals, the data voltage Dataj corresponding to the OLED pixel circuit 112*a* among the data voltages Data1 to DataX can be written into the storage capacitor 202. The OLED pixel circuit 112*a* may perform an internal compensation to compensate for OLED degradation.

FIG. 2B is a schematic circuit block diagram of an exemplary OLED pixel circuit 112*b* depicted in FIG. 1. The OLED pixel circuit 112*b* of FIG. 2B may be used as the OLED pixel circuits 112*p* in FIG. 1, and includes an OLED 211, a pixel driving circuit formed by 6 n-channel type (n-type) TFTs T1-T6, and at least one storage capacitor 212. The n-type TFTs (pixel driving circuit) illustrated in FIG. 2B are controlled by the driving control signals, including the gate scan signal $SCAN_i$, the initialization scan signal $INIT_i$, and the emission scan signal $EM_i$. Based on the control of the driving control signals, the data voltage Dataj corresponding to the OLED pixel circuit 112*b* among the data voltages Data1 to DataX can be written into the storage capacitor 212. The OLED pixel circuit 112*b* may perform an internal compensation to compensate for OLED degradation.

FIG. 3 is a timing sequence diagram illustrating driving control signals generated by the driving apparatus 120 for the OLED pixel circuit using p-type TFTs (e.g., the OLED pixel circuit 112*a* of FIG. 2A). The driving control signals illustrated in FIG. 3 the gate clock signals CLK1 to CLK4, the initialization clock signals INT1 to INT4 and the emission clock signals EM_CLK1 to EM_CLK4, and are provided to the gate driving circuit 111 (or referred to as a GOA circuit in FIG. 1).

A driving scheme of the OLED pixel circuit 112*a* (or 112*b*), referred to FIG. 2A-2B and FIG. 3, may be divided into three stages.

The first stage is an initialization stage. During the initialization stage, the TFT T2 of the OLED pixel circuit 112*a* is turned on by the initialization scan signal $INIT_i$ so as to transfer an initialization voltage V_INT to a terminal of the storage capacitor 202 and the gate terminal of the TFT T1 (which is operated as a driving TFT). The initialization voltage V_INT may be a constant supply voltage.

The second stage is a data writing and compensation stage. During the data writing and compensation stage, the TFTs T3 and T4 of the OLED pixel circuit 112*a* are turned on by the gate scan signal $SCAN_i$, and the driving apparatus 120 writes the data voltage Dataj into the OLED pixel circuit 112*a*.

The third stage is an emission stage. During the emission stage, the TFTs T5 and T6 of the OLED pixel circuit 112*a* are turned on by the emission scan signal $EM_i$ such that a driving current flows through the OLED 201 to emit light, so as to display a gray level corresponding to the data voltages Dataj.

The initialization stage of the OLED pixel circuits 112*a* of the $m^{th}$ horizontal line may start while OLED pixel circuits 112*a* of the $(m-1)^{th}$ horizontal line is being in the data writing and compensation stage or in the emission stage. In an OLED pixel circuit using p-type TFTs (e.g., the OLED pixel circuit 112*a* of FIG. 2A), the initialization voltage V_INT may be a negative voltage. During the frame transition (e.g., from a frame N to a frame (N+1)), all OLED pixel circuits 112*a* in the same horizontal line are initialized at the same time.

SUMMARY

The invention provides a driving apparatus of a light emitting diode (LED) display device. The driving apparatus includes a timing control circuit. The timing control circuit outputs a plurality of driving control signals to a gate driving circuit on an LED display panel of the LED display device. Wherein, the plurality of driving control signals comprises a first driving control signal and a second driving control signal, and the pulse width of the first driving control signal in a first horizontal line period is configured to be different from the pulse width of a second driving control signal in a second horizontal line period preceding to the first horizontal line period.

The invention provides a driving apparatus of an LED display device. The driving apparatus includes a voltage regulator circuit. The voltage regulator circuit outputs an initialization voltage to the LED display panel of the LED display device. The initialization voltage is configured to have a first voltage level in at least a first horizontal line period. The first voltage level is different from a second voltage level that the initialization voltage is configured to have in a second horizontal line period preceding to the first horizontal line period.

The invention provides a driving apparatus of an LED display device, the LED display device comprising an LED display panel comprising a plurality of horizontal lines. The driving apparatus includes a compensation circuit and a timing control circuit. The compensation circuit is configured to compare image data corresponding to a target horizontal line among the plurality of horizontal lines in a first frame and image data corresponding to the target horizontal line in a second frame preceding to the first frame, and generate a control signal with respect to a comparing result. The timing control circuit is coupled to the compensation circuit for receiving the control signal, and configured to set up the pulse width of a plurality of driving control signals according to the control signal and output the plurality of driving control signals to a gate driving circuit on the LED display panel.

The invention provides a driving apparatus of an LED display device, the LED display device comprising an LED display panel comprising a plurality of horizontal lines. The driving apparatus includes a compensation circuit and a voltage regulator circuit. The compensation circuit is configured to compare image data corresponding to a target horizontal line among the plurality of horizontal lines in a first frame and image data corresponding to the target horizontal line in a second frame preceding to the first frame, and generate a control signal with respect to a comparing result. The voltage regulator circuit is coupled to the compensation circuit for receiving the control signal, and configured to set up an initialization voltage according to the control signal and output the initialization voltage to the LED display panel.

The invention provides a driving apparatus of an LED display device. The LED display device includes an LED display panel having a pixel array comprising a plurality of pixel cells, wherein each pixel cell includes an LED element and a first control element which determines luminance of the LED element in an emission stage of the pixel cell. The first control element has a control terminal coupled to an initialization terminal of the pixel cell. The driving apparatus includes a voltage regulator circuit. The voltage regulator circuit is coupled to the initialization terminal of the pixel cell, and is configured to generate an initialization voltage to the initialization terminal of the pixel cell in an initialization stage of the pixel cell. The voltage regulator circuit is configured to generate a first initialization voltage during a first display period of the frame period, to the initialization terminal of a first pixel cell of the pixel cells, and generate a second initialization voltage having a voltage level different from the first initialization voltage during a second display period of the frame period, to the initialization terminal of a second pixel cell of the pixel cells.

The invention provides a driving apparatus of an LED display device. The LED display device includes an LED display panel having a pixel array comprising a plurality of pixel cells, each pixel cell comprising an LED element, a first control element which determines luminance of the LED element in an emission stage of the pixel cell, and a second control element. The first control element has a control terminal coupled to the second control element. The second control element has a control terminal configured to receive a driving control signal and the second control element is configured to establish a connection between the control terminal of the first control element and an initialization terminal of the pixel cell. The driving apparatus includes a voltage regulator circuit and a control circuit. The voltage regulator circuit is coupled to the initialization terminal of the pixel cell, and is configured to generate an initialization voltage for the pixel cell in an initialization stage of the pixel cell. The control circuit is coupled to the control terminal of the second control element of the pixel cell, and is configured to generate a driving control signal for the pixel cell, wherein the driving control signal controls the second control element of the pixel cell to transfer the initialization voltage to the control terminal of the first control element of the pixel cell. The control circuit is configured to generate a first driving control signal having a first pulse width during a first display period of a frame period, for a first pixel cell of the pixel cells, and generate a second driving control signal having a second pulse width different from the first pulse width during a second display period of the frame period, for a second pixel cell of the pixel cells.

The invention provides a driving apparatus of an LED display device. The LED display device includes an LED display panel having a pixel array comprising a plurality of pixel cells, each pixel cell comprising an LED element, a charge storage element, a first control element which determines luminance of the LED element in an emission stage, and a second control element. The first control element has a control terminal coupled to a first terminal of the charge storage element, and in the pixel cell a path being formed between a data input terminal of the pixel cell and the first terminal of the charge storage element via the second control element in a data writing and compensation stage. The driving apparatus includes a data driving circuit and a control circuit. The data driving circuit is coupled to the data input terminal of the pixel cell, and is configured to generate a data voltage corresponding to the pixel cell. The control circuit is coupled to the second control element of the pixel cell, and is configured to generate a driving control signal for the pixel cell, wherein the driving control signal controls the second control element of the pixel cell to conduct the path in the data writing and compensation stage so as to charge or discharge the charge storage element according to the data voltage generated by the data driving circuit. The control circuit is configured to generate a first driving control signal having a first pulse width during a first display period of a frame period, for a first pixel cell of the pixel cells, and generate a second driving control signal having a second pulse width different from the first pulse width during a second display period of the frame period, for a second pixel cell of the pixel cells.

The invention provides an LED display panel including a pixel array. The pixel array includes a plurality of pixel cells, each pixel cell comprising an LED element, a first control element which determines luminance of the LED element in an emission stage of the pixel cell, and an initialization terminal. Wherein, among the pixel cells, the initialization terminal of a first pixel cell is configured to receive a first initialization voltage during a first display period of a frame period, and the initialization terminal of a second pixel cell is configured to receive a second initialization voltage having a voltage level different from the first initialization voltage during a second display period of the frame period.

The invention provides an light emitting diode (LED) display panel including a pixel array. The pixel array includes a plurality of pixel cells, each pixel cell comprising an LED element, a first control element which determines luminance of the LED element in an emission stage of the pixel cell, and a second control element. The first control element has a control terminal coupled to an initialization terminal of the pixel cell and the second control element. The second control element has a control terminal and being configured to establish a connection between the control terminal of the first control element and an initialization terminal of the pixel cell. Wherein, among the pixel cells, the control terminal of the second control element of a first pixel cell is configured to receive a first driving control signal having a first pulse width during a first display period of a frame period, and the control terminal of the second control element of a second pixel cell is configured to receive a second driving control signal having a second pulse width different from the first pulse width during a second display period of the frame period.

The invention provides an LED display panel including a pixel array. The pixel array includes a plurality of pixel cells, each pixel cell comprising an LED element, a charge storage element, a first control element which determines luminance of the LED element in an emission stage, and a second control element, the first control element having a control terminal coupled to a first terminal of the charge storage element, wherein in the pixel cell, a path is formed between a data input terminal of the pixel cell and the first terminal of the charge storage element via the second control element in a data writing and compensation stage. Wherein, among the pixel cells, the control terminal of the second control element of a first pixel cell is configured to receive a first driving control signal having a first pulse width during a first display period of a frame period, and the control terminal of the second control element of a second pixel cell is configured to receive a second driving control signal having a second pulse width different from the first pulse width during a second display period of the frame period.

In order to make the aforementioned and other features and advantages of the invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
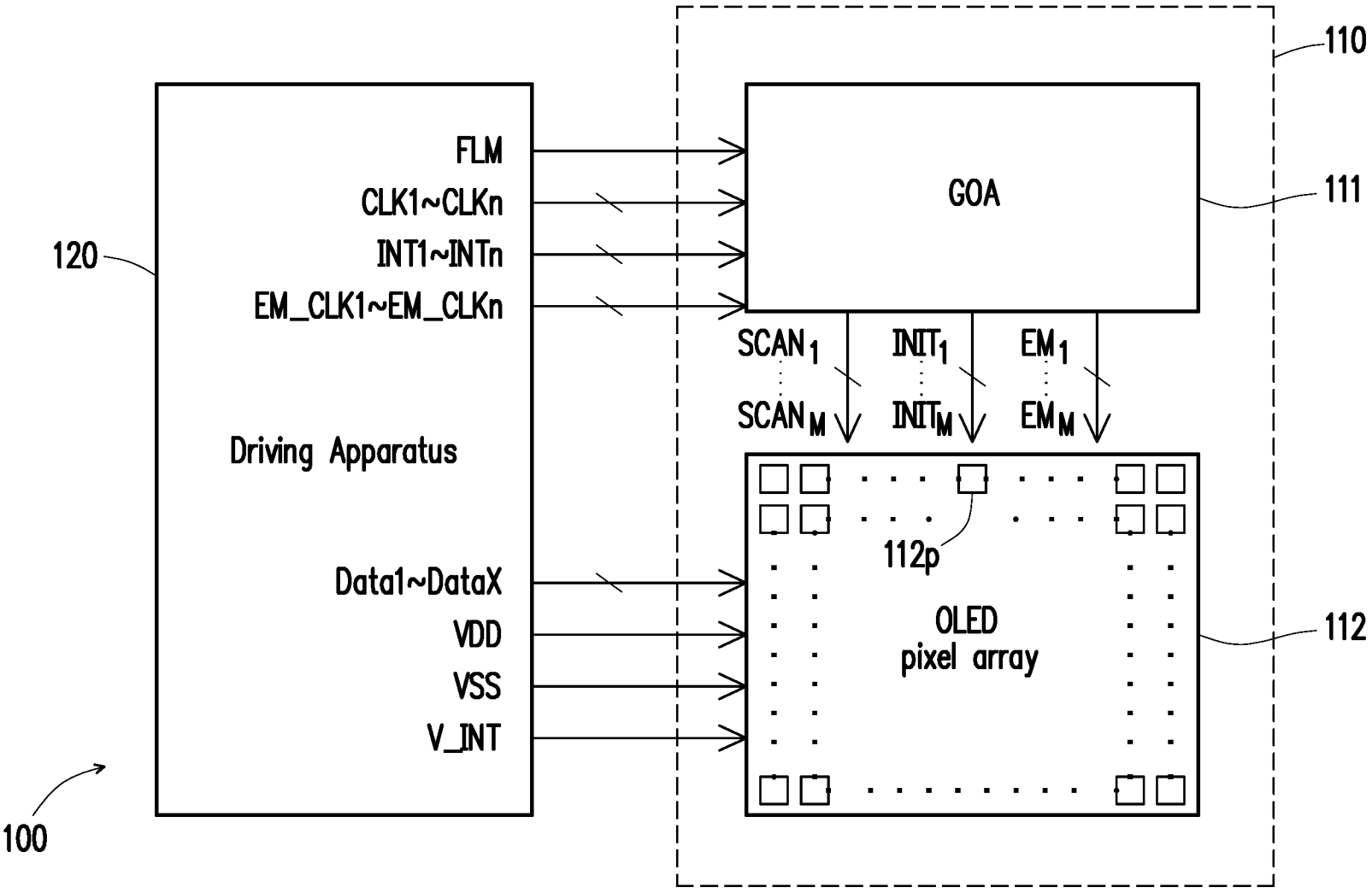
FIG. 1 (RELATED ART)
FIG. 1 illustrates a circuit block diagram of a light emitting diode (LED) display device.

A term "couple" used in the full text of the disclosure (including the claims) refers to any direct and indirect connections. For instance, if a first device is described to be coupled to a second device, it is interpreted as that the first device is directly coupled to the second device, or the first device is indirectly coupled to the second device through other devices or connection means. Moreover, wherever possible, components/members/steps using the same referential numbers in the drawings and description refer to the same or like parts. Components/members/steps using the same referential numbers or using the same terms in different embodiments may cross-refer related descriptions.

Figure 2B:
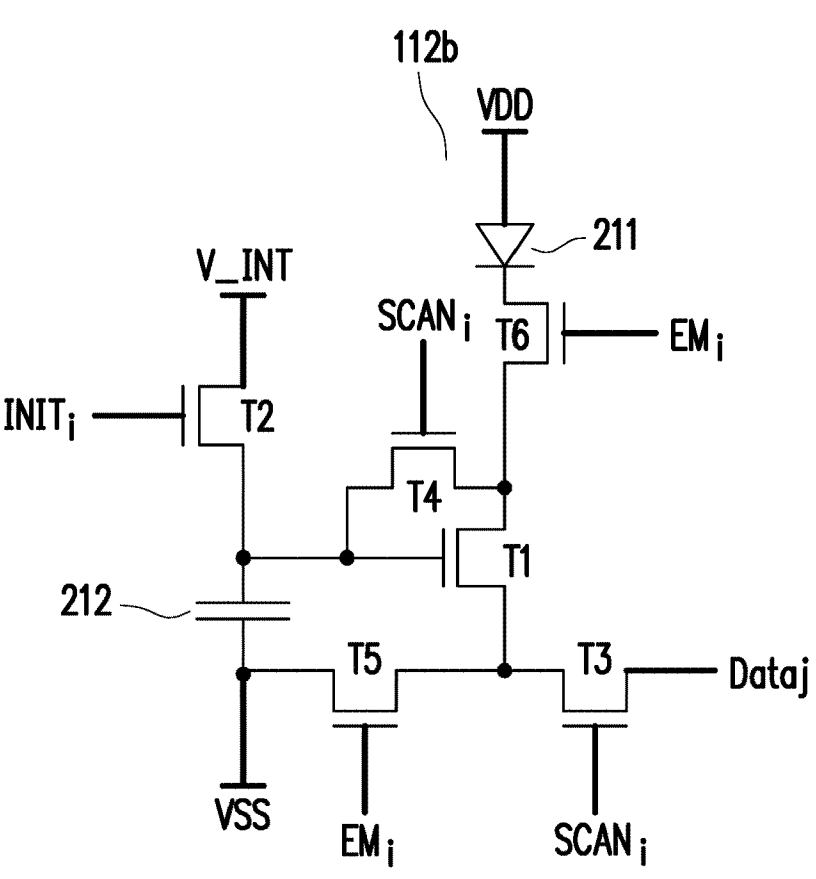
FIG. 2B(RELATED ART)
FIG. 2B is a schematic circuit block diagram of an exemplary OLED pixel circuit depicted in FIG. 1.
Figure 2A:
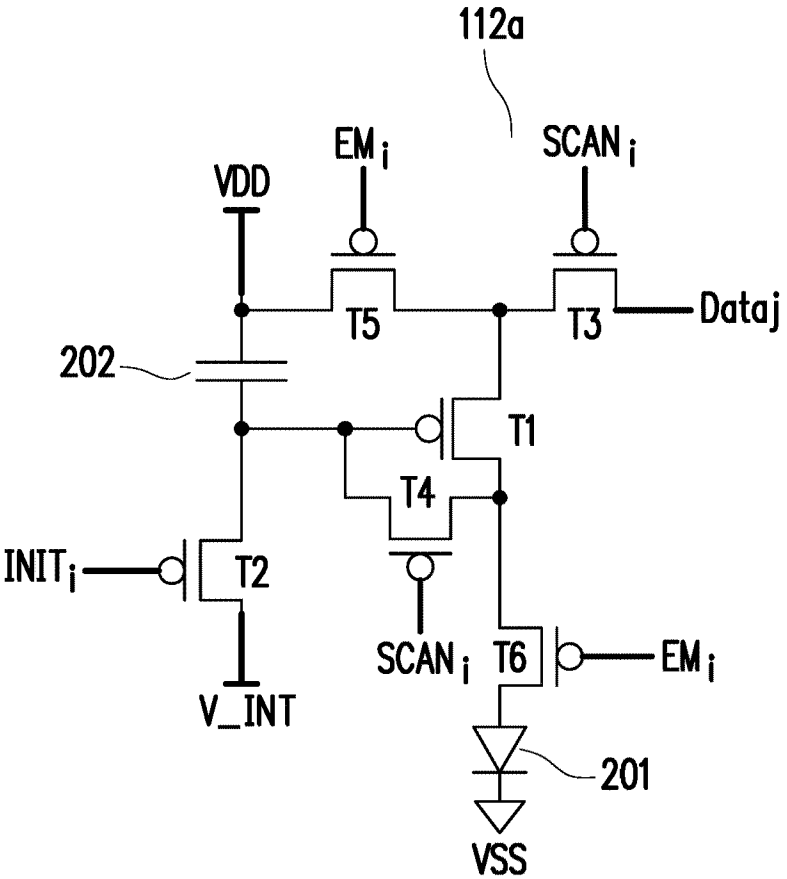
FIG. 2A(RELATED ART)
FIG. 2A is a schematic circuit block diagram of an exemplary OLED pixel circuit depicted in FIG. 1.
Figure 4A:
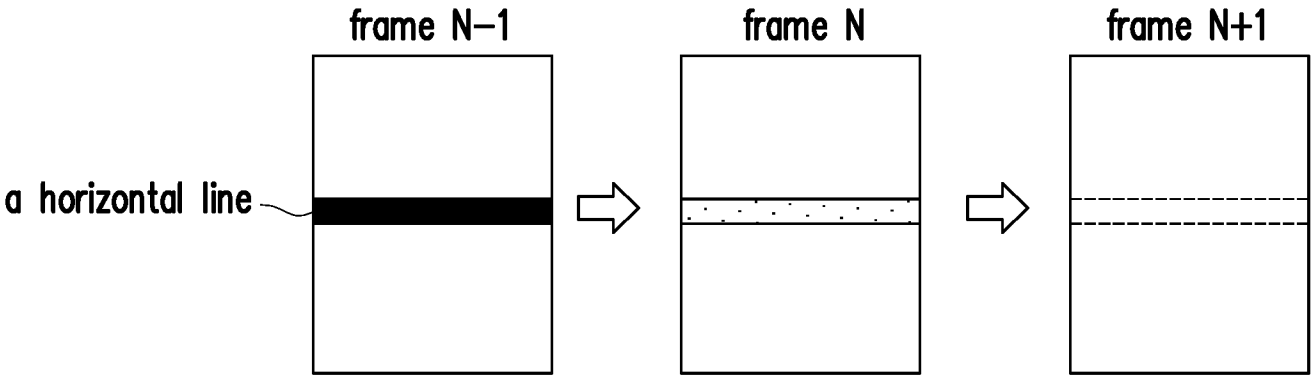
FIG. 4A is a schematic diagram of one same horizontal line in different frame according to an embodiment of the invention.

FIG. 4A is a schematic diagram of a horizontal line (i.e., a row of pixels) of an OLED display panel in different frames according to an embodiment of the invention. Referring to FIG. 2A and FIG. 4A for example, a horizontal line consisting of a plurality of OLED pixel circuits (112*a*) is assumed to display a relatively low gray level (e.g., black) in the frame N−1 and display a relatively high gray level (e.g., white) in the frame N and subsequent frames. From the frame N−1 to the frame N, since the gray level of the OLED pixel circuits of the horizontal line significantly changes, from the relatively low gray level (e.g., black) to a relatively high gray level (e.g., white), the OLED pixel circuits of the horizontal line may have not enough time to be sufficiently initialized and not enough time to perform internal compensation. In such a condition, a gate electrode voltage of a driving TFT (e.g., T1 in FIG. 2A) of each OELD pixel circuits of the horizontal line may be not ideal as the expected, and results in a gap between an ideal steady-state emission luminance of the OLED pixel circuits of the horizontal line and the actual emission luminance of the OLED pixel circuits of the horizontal line in the frame N. With respect to the case of the OELD pixel circuits using p-type TFTs, the luminance gap means a luminance drop. The actual emission luminance of the OLED pixel circuits of the horizontal line in the frame N may be lower than the expected emission luminance, and in other words, human eyes may observe the m horizontal line displaying not bright enough. The actual emission luminance of the OLED pixel circuits of the horizontal line in the frame N+1 and subsequent frames may be approximate to the ideal emission luminance so that the horizontal line looks bright as the expected.

Figure 4B:
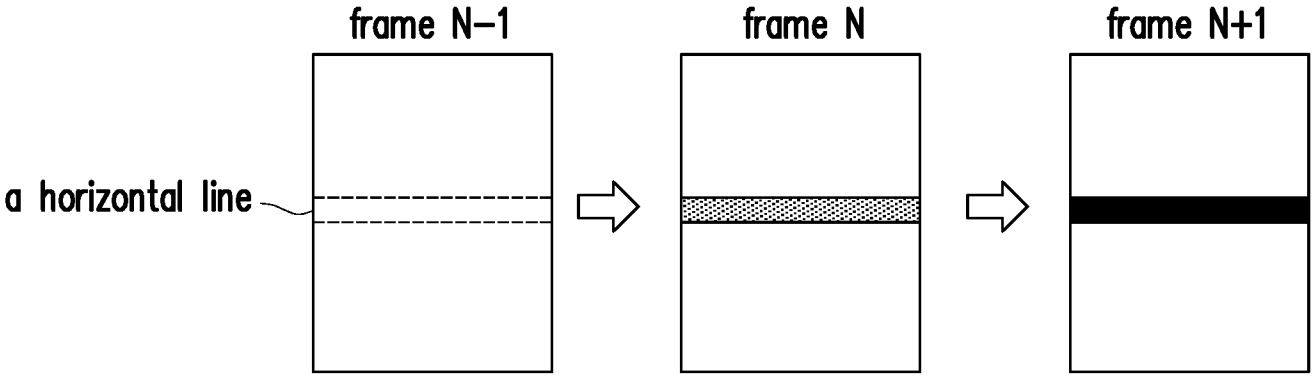
FIG. 4B is a schematic diagram of one same horizontal line in different frame according to another embodiment of the invention.

FIG. 4B is a schematic diagram of a horizontal line of an OLED display panel in different frames according to another embodiment of the invention. Referring to FIG. 2B and FIG. 4B for example, a horizontal line consisting of a plurality of OLED pixel circuits (112*b*) is assumed to display a relatively high gray level (e.g., white) in the frame N−1 and display a relatively low gray level (e.g., black) in the frame N and subsequent frames. From a frame N−1 to a frame N, since the gray level of the OLED pixel circuits of the horizontal line significantly changes, from the relatively high gray level (e.g., white) to the relatively low gray level (e.g., black), insufficient time for initialization and internal compensation also occurs and a gate electrode voltage of a driving TFT (e.g., T1 in FIG. 2B) of each OELD pixel circuits of the horizontal line may be not ideal as the expected. As a result, a luminance gap between an ideal steady-state emission luminance of the OLED pixel circuits of the horizontal line and the actual emission luminance of the OLED pixel circuits of the horizontal line appears in the frame N. With respect to the case of the OELD pixel circuits using n-type TFTs, the luminance gap means an over-brightness. The actual emission luminance of the OLED pixel circuits of the horizontal line in the frame N may be higher than the expected emission luminance, and in other words, human eyes may observe the horizontal line displaying not dark enough. The actual emission luminance of the OLED pixel circuits of the horizontal line in the frame N+1 and subsequent frames may be approximate to the ideal emission luminance so that the horizontal line looks dark as the expected.

In a brief, when image data significantly changes from one frame to the next frame, the problem of insufficient time for initialization and data writing occurs, and undesired luminance gap (whatever the actual luminance is lower or higher) in the next frame may easily be observed by a user.

Figure 3:
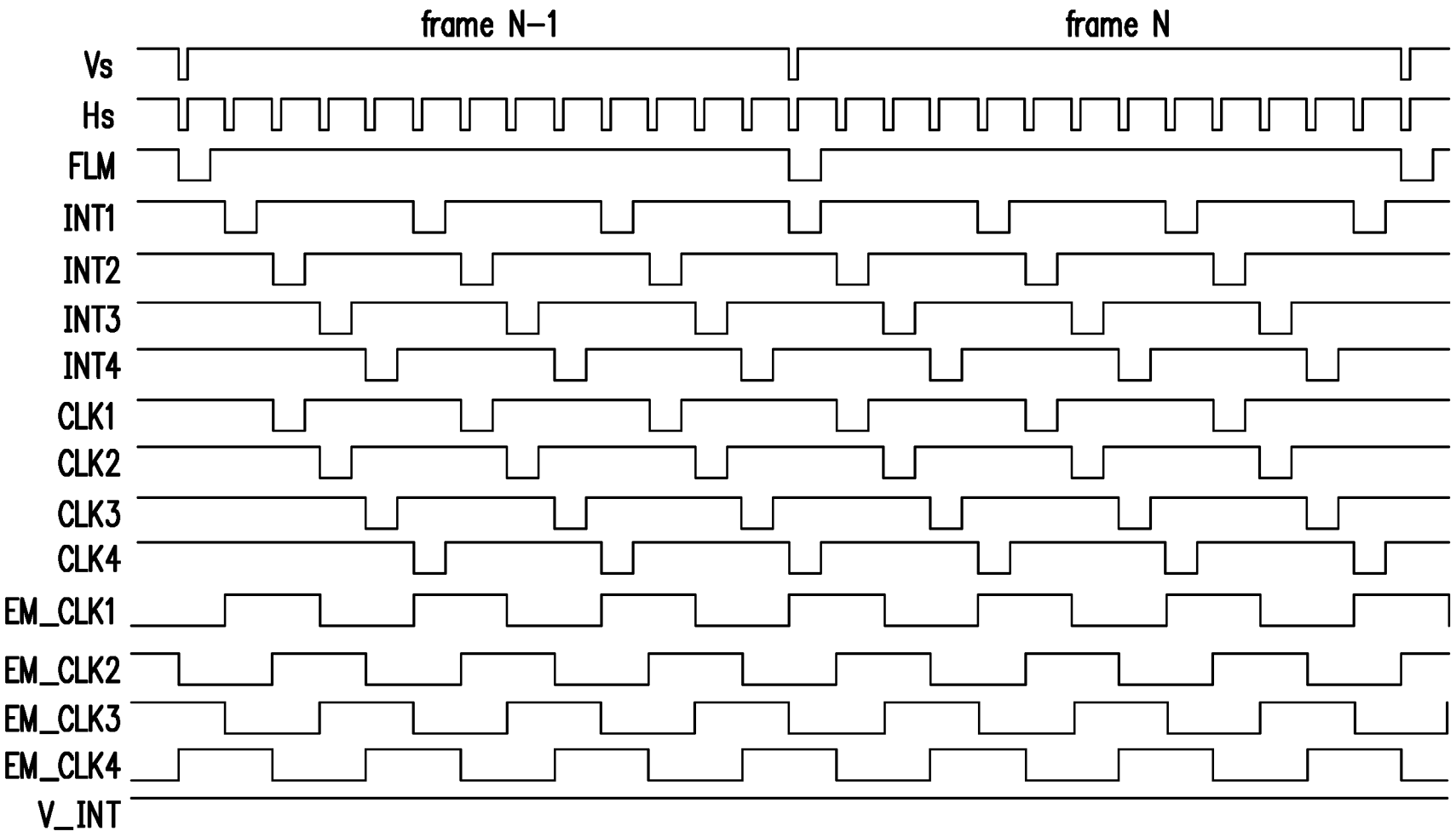
FIG. 3 (RELATED ART)
FIG. 3 is a timing sequence diagram illustrating control signals generated by the driving apparatus for the OLED pixel circuit using p-type TFTs.
Figure 5:
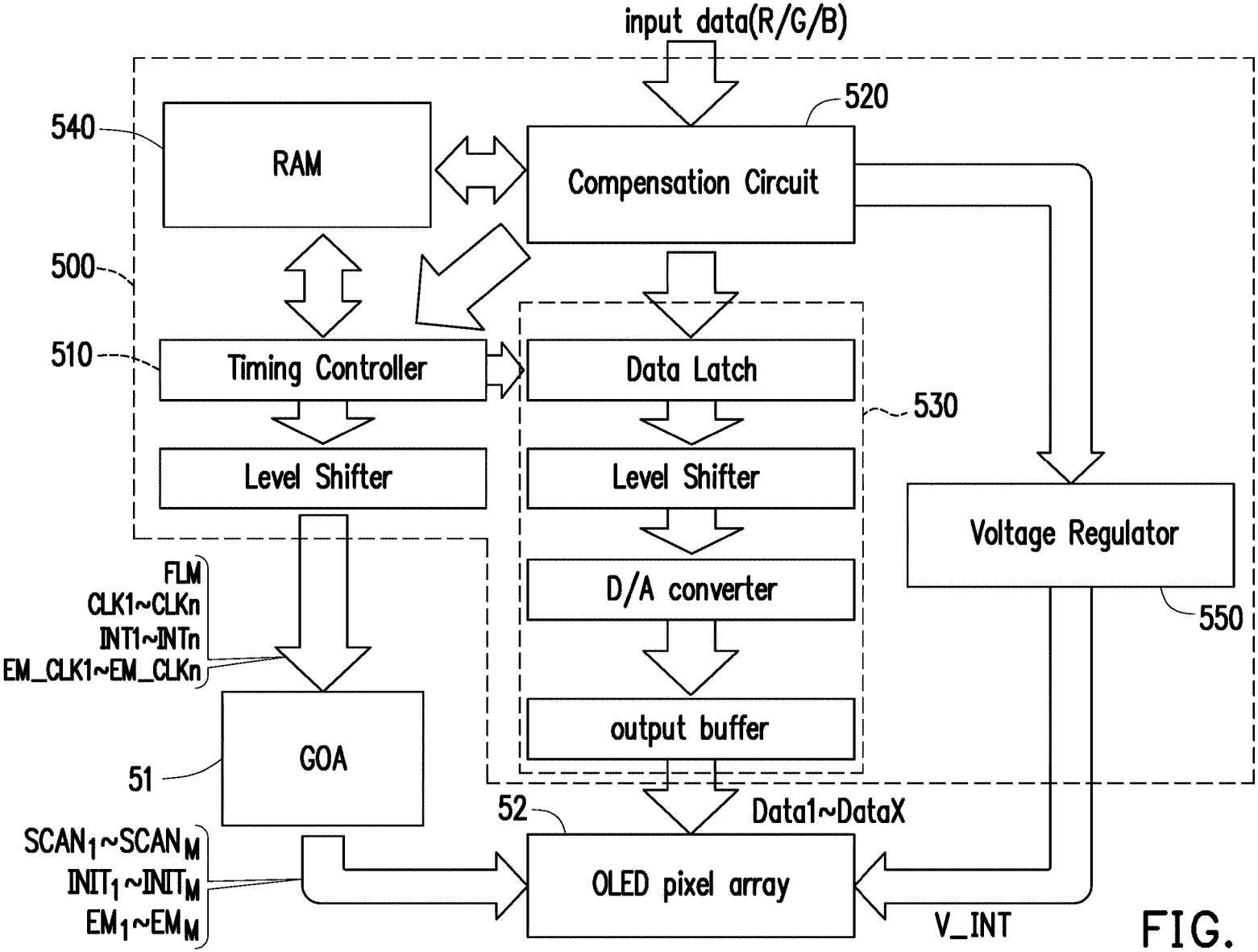
FIG. 5 is a circuit block diagram of a driving apparatus according to an embodiment of the present invention.

FIG. 5 is a circuit block diagram of a driving apparatus 500 according to an embodiment of the present invention. The driving apparatus 500 provides driving control signals such as gate clock signals CLK1 to CLKn, initialization clock signals INT1 to INTn and emission clock signals EM_CLK1 to EM_CLKn, and a start pulse signal FLM, to a gate driving circuit 51 (or referred to as a gate on array (GOA) circuit in FIG. 5) deposed on an OLED display panel. On the other hand, the driving apparatus 500 provides data voltages (i.e., pixel voltages) Data1 to DataX corresponding to output channels of the driving apparatus 500, a system supply voltage VDD, a reference voltage VSS, and an initialization voltage V_INT to an OLED pixel array 52 of an OLED display panel. The OLED pixel array 52 includes a plurality of pixel circuits, or called pixel cells, each pixel circuit is as a subpixel. The OLED pixel array 52 may be an AMOLED pixel array. The purpose that the driving apparatus 500 provides the gate clock signals CLK1 to CLKn, the initialization clock signals INT1 to INTn, and the emission clock signals EM_CLK1 to EM_CLKn to the gate driving circuit 51 and provides the initialization voltage V_INT and other voltages to the OLED pixel array 52 may be inferred with reference to the descriptions related to the related art illustrated in FIG. 1 to FIG. 3 and thus, will not be repeated.

According to one of embodiments of the present invention, the driving apparatus 500 includes a timing control circuit 510, a compensation circuit 520, a data driving circuit 530 and a voltage regulator 550. The driving apparatus 500 is used for driving an OLED display panel of the OLED display device. The compensation circuit 520 may be a part of a digital control circuit of the driving apparatus 500. The voltage regulator 550 is configured to provide an initialization voltage V_INT to the OLED pixel array 52 of the OLED display panel. The compensation circuit 520 is configured to compare image data corresponding to a target horizontal line among a plurality of horizontal lines of the OLED display panel of the OLED display device in a first frame (frame N) and image data corresponding to the target horizontal line in a second frame (frame N−1) preceding to the first frame, and for example, to calculate a gray level difference between image data corresponding to the target horizontal line in the first frame (frame N) and image data corresponding to the target horizontal line in the second frame (frame N−1). The target horizontal line may be each one of the horizontal lines of the OLED display panel which image data is being processed. The compensation circuit 520 generates a control signal to the timing control circuit 510 and/or the voltage regulator 550 according to the gray level difference.

The timing control circuit 510 is coupled to the compensation circuit 520 for receiving the control signal. The timing control circuit 510 is configured to set up the pulse width of a plurality of driving control signals according to the control signal. The timing control circuit 510 outputs plurality of driving control signals to a gate driving circuit 51 (or referred to as GOA circuit in FIG. 5) on the OLED display panel of the OLED display device. The plurality of driving control signals may include the gate clock signals CLK1 to CLKn, or the initialization clock signals INT1 to INTn, wherein n is an integer more than 1. The plurality of driving control signals includes a first driving control signal and a second driving control signal. In other words, the first driving control signal and the second driving control signal may be two of the gate clock signals CLK1 to CLKn, or two of the initialization clock signals INT1 to INTn. In response to the control signal which indicates that a gray level difference between the image data corresponding to the target horizontal line in the first frame (frame N) and the image data corresponding to the target horizontal line in the second frame (frame N−1) is determined to be greater than a threshold value (and generally speaking, a significant gray level difference), the timing control circuit 510 may set up the pulse width of the first driving control signal in a first horizontal line period to be different from the pulse width of a second driving control signal in a second horizontal line period preceding to the first horizontal line period. It is noted that the pulse width in this description means active pulse width. The pulse width of the second driving control signal may have a normal configuration (which is not adjusted). On the other hand, in response to the control signal which indicates that a gray level difference between the image data corresponding to the target horizontal line in the first frame (frame N) and the image data corresponding to the target horizontal line in the second frame (frame N−1) is determined to be not greater than the threshold value, the timing control circuit 510 may set up the pulse width of the first driving control signal associated with the target horizontal line to be the normal pulse width.

Generally, the length of a horizontal line period is determined based on a horizontal synchronization signal (Hs) or other similar signal. In a case of the period of the horizontal synchronization signal being constant, the horizontal line period for each horizontal line is configured to be the same length, and the pulse width of the first driving control signal is configured to be less than the pulse width of the second driving control signal by the timing control circuit 510 (in response to the control signal which indicates that the gray level difference is determined to be greater than the threshold value). In another case of the period of the horizontal synchronization signal capable of being adjusted by the driving apparatus 500 (in response to the control signal which indicates that the gray level difference is determined to be greater than the threshold value), the pulse width of the first driving control signal may be configured to be greater than the pulse width of the second driving control signal by the timing control circuit 510. It is noted that the first horizontal line period may have different meanings which depend on the types of the plurality of driving control signals. The plurality of driving control signals may be the gate clock signals CLK1 to CLKn and in such a case, the first horizontal line period is a period during which the image data corresponding to the target horizontal line in the first frame (frame N) are output to the target horizontal line, i.e., target horizontal line period. Or, the plurality of driving control signals may be the initialization clock signals INT1 to INTn and in such a case, the first horizontal line period is preceding to the target horizontal line period. Let m-th horizontal line denote the target horizontal line where a significant gray level difference occurs, the period of the target horizontal line is m-th horizontal line period, the first horizontal line period with respect to a first gate clock signal (as the first driving control signal) is the m-th horizontal line period, and the first horizontal line period with respect to a first initialization clock signal (as the first driving control signal) is the (m−1)-th horizontal line period. Further referring to FIG. 5, the voltage regulator 550 is coupled to the compensation circuit 520 for receiving the control signal generated by the compensation circuit 520. The voltage regulator 550 is configured to set up the initialization voltage V_INT according to the control signal and output the initialization voltage V_INT to the OLED display panel. Alternatively, the voltage regulator 550 may be capable of generating two or more initialization voltages to the OLED display panel. In response to the control signal which indicates that a gray level difference between the image data corresponding to the target horizontal line in the first frame (frame N) and the image data corresponding to the target horizontal line in the second frame (frame N−1) is determined to be greater than a threshold value, the voltage regulator 550 may set up the voltage level of the initialization voltage V_INT to be a first voltage level in at least a first horizontal line period. The first voltage level is different from a second voltage level that the initialization voltage V_INT is set up to be in a second horizontal line period preceding to the first horizontal line period. The second voltage level that the initialization voltage V_INT has may be a normal configuration (which is not adjusted).

Based on the embodiment related to the compensation circuit 520 and the timing control circuit 510 as above, the pulse width of a first gate clock signal (as the first driving control signal) of the gate clock signals CLK1 to CLKn, or the pulse width of a first initialization clock signal (as the first driving control signal) of the initialization clock signals INT1 to INTn, can be adjusted in response to a significant gray level difference between the image data corresponding to the (target) m-th horizontal line in the frame N and image data corresponding to the m-th horizontal line in the frame N−1 occurring. In such a way, the pulse width of a gate scan signal $SCAN_m$ of the gate scan signals $SCAN_1$ to $SCAN_M$, which is generated based on the first gate clock signal (as the first driving control signal) by the gate driving circuit 51 and controls the pixel circuits of the m-th horizontal line, or the pulse width of an initialization scan signal $INIT_m$ of the initialization scan signals $INIT_1$ to $INIT_M$, which is generated based on the first initialization clock signal (as the first driving control signal) by the gate driving circuit 51 and controls the pixel circuits of the m-th horizontal line, may be adjusted correspondingly.

Based on the embodiment related to the compensation circuit 520 and the voltage regulator 550 as above, the voltage level of the initialization voltage V_INT provided by the voltage regulator 550 to the OLED pixel array 52 can be adjusted to be at a different level at least during the (m−1)-th horizontal line period, in response to a significant gray level difference between the image data corresponding to the (target) m-th horizontal line in the frame N and image data corresponding to the m-th horizontal line in the frame N−1 occurring.

For data transfer from a host device, such as an application processor used in a mobile device as the OLED display device which includes the driving apparatus 500, a high speed serial data interface such as a mobile industry processor interface (MIPI) may be used to communicate with the driving apparatus 500. A frame memory 540 such as a random access memory (RAM) is installed in the driving apparatus 500. According to the MIPI related specification, a still image (as host data) may be transmitted from the host device via the frame memory 540 to the timing control circuit 510 and to the digital control circuit (where the compensation circuit 520 is included) in a command mode, and a video stream (as host data) may be transmitted from the host device to the timing control circuit 510 and to the digital control circuit via the frame memory 540 or bypass the frame memory 540 in a video mode, which are called a video mode via RAM and a video mode bypass RAM respectively.

Figure 6:
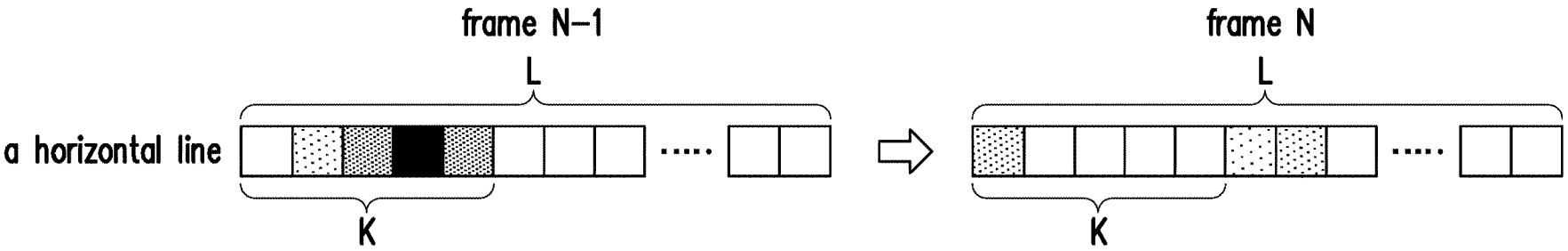
FIG. 6 schematically illustrates gray level differences of a plurality of subpixels of the m-th horizontal line from a frame N−1 (i.e., the previous frame) to a frame N (i.e., the current frame).

The operation determining whether a significant gray level difference occurs between two adjacent frames is briefly described as the following. FIG. 6 schematically illustrates gray level difference of a plurality of subpixels of a horizontal line between a frame N−1 (i.e., the previous frame) and a frame N (i.e., the current frame). The horizontal line may be regarded as including (L/K) subpixel groups, wherein L is the number of the same-colored subpixels of each horizontal line and K is the number of subpixels of each (same-colored) subpixel group. K is an integer which equals one or more. During frame transition from the frame N−1 to the frame N as illustrated in FIG. 6, the driving apparatus 500 including the compensation circuit 520 may respectively compare gray level values of every K subpixels of the horizontal line in the frame N−1 and gray level values of every K subpixels of the horizontal line in the frame N, to obtain a sum of a plurality of gray level differences with respect to the subpixel groups.

Let $d_i$ denote a gray level difference between a gray level value $p_{i,j,N-1}$ of $i^{th}$ subpixel of $j^{th}$ subpixel group of the horizontal line in the frame N−1 and a gray level value $p_{i,j,N}$ of the same $i^{th}$ subpixel of $j^{th}$ subpixel group of the horizontal line in the frame N, $d_i=p_{i,j,N}-p_{i,j,N-1}$. In total K gray level differences $d_1$ to $d_K$ with respect to each subpixel group, the driving apparatus may concern some of gray level differences and may not concern other gray level differences. In an embodiment, depending on the channel type (n-type or p-type) of TFTs that the OLED pixel driving circuits uses, the driving apparatus 500 may configure a threshold to keep those gray level differences the driving apparatus concerns and to neglect other gray level differences the driving apparatus does not care. For example, when the OLED pixel driving circuits uses p-type TFTs, a gray level difference from a lower gray level to a higher gray level may be a concern and be kept since the symptom illustrated in the FIG. 4A is easily observed by the end user, whereas a gray level difference from a higher gray level to a lower gray level may be neglected since the symptom illustrated in the FIG. 4B is not obviously observed. On the other hand, when the OLED pixel driving circuits uses n-type TFTs, a gray level difference from a higher gray level to a lower gray level may be kept since the symptom illustrated in the FIG. 4B is more easily observed by the end user. In another example, the driving apparatus may configure a threshold to assure that interested gray level differences are significant differences, and in such a case a slight gray level difference may be neglected even though it is also a difference from a lower gray level to a higher gray level (based on the case of the OLED pixel driving circuits using p-type TFTs). The way to find the interested gray level differences is various and is not limited.

With respect to each same-colored subpixel group of a horizontal line, the driving apparatus may accumulate a plurality of the interested gray level differences to generate a sum of the interested gray level differences, and determine if the sum with respect to each same-colored subpixel group is equivalent or larger than a threshold. Furthermore, the driving apparatus may include a hit counter utilized for counting, the number of times (with respect to a horizontal line) that the sum is equivalent or larger than the threshold. For example, the counting value of the hit counter adds 1 from zero when the sum of the interested gray level differences with respect to a subpixel group $P_1$ is equivalent to the threshold; the counting value remains the same (i.e., 1) when the sum of the interested gray level differences with respect to a subpixel group $P_2$ is smaller than the threshold; the counting value still remains the same (i.e., 1) when the sum of the interested gray level differences with respect to a pixel group $P_3$ is smaller than the threshold; the counting value of the hit counter becomes 2 when the sum of the interested gray level differences with respect to a pixel group $P_4$ is larger than the threshold.

The above-mentioned is a brief operation of gray level analysis according to an embodiment of the invention. In response to that the counting value is determined to be equivalent to or larger than a counting threshold, the driving apparatus 500 may configure the pulse width of one or more of the driving control signals (e.g., the gate clock signals CLK1 to CLKn, or the initialization clock signals INT1 to INTn) during a proper horizontal line period(s) to be different from the normal pulse width, to compensate for the emission luminance gap (e.g., a drop, or an over-brightness) of the OLED pixel circuits of the horizontal line.

Figure 7:
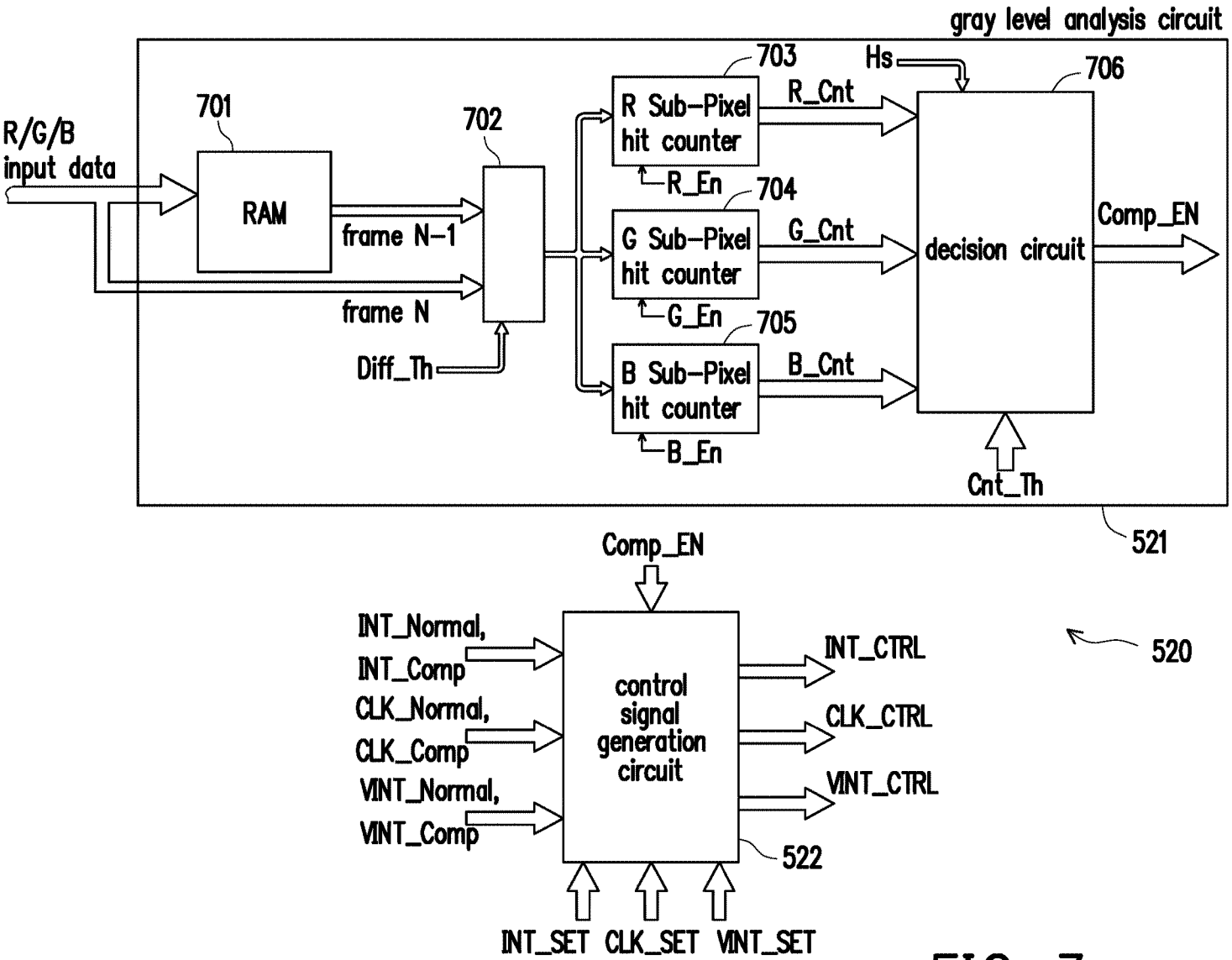
FIG. 7 is a circuit block diagram of the compensation circuit in FIG. 5 according to an embodiment of the present invention.

FIG. 7 is a circuit block diagram of the compensation circuit 520 in FIG. 5 according to an embodiment of the present invention. The above-mentioned gray level analysis may be implemented in the compensation circuit 520. The compensation circuit 520 in FIG. 7 includes a gray level analysis circuit 521 and a control signal generation circuit 522. The gray level analysis circuit 521 includes a RAM 701, a comparator 702, a R (red) sub-pixel hit counter 703, a G (green) sub-pixel hit counter 704, a B (blue) sub-pixel hit counter 705 and a decision circuit 706. The size of RAM 701 may be designed based on requirement, and the RAM 701 may have a size large enough to store data (which is usually compressed or reduced) with respect to a frame (as the previous frame N−1). Referring to FIG. 7, with respect to each color, the input data to the RAM 701 may be original input data (e.g., 10 bits) for subpixels of a horizontal line, truncated input data (e.g., higher 5 bits of the 10-bit original input data) for subpixels of a horizontal line, an average input data (e.g., 10 bits) of a horizontal line, or a truncated average input data which is higher 5 bits of 10-bit average input data of a horizontal line, etc., which is not limited therein.

For example, the comparator 702 receives and compares input data of every subpixel of each horizontal line of the frame N (current frame) and an average input data of each horizontal line of the frame N−1 (previous frame) stored in the RAM 701, and outputs a comparing result to a R sub-pixel hit counter 703, a G sub-pixel hit counter 704 and a B sub-pixel hit counter 705. Herein, the comparing result is with respect to a subpixel. Enable signals R_En, G_En, and B_En are used for controlling enable/disable status of the subpixel hit counters so that every comparing result can be processed by a hit counter with respect to the correct subpixel color. In more detailed exemplary operation of the comparator 702, the comparator 702 calculates a gray level difference between data (i.e., gray level) of a subpixel of a horizontal line of the frame N and average input data of subpixels (of the same color) of the horizontal line of the frame N−1, and compares the gray level difference with a threshold Diff_Th so as to generate the comparing result. For example, a bit 1 may be the comparing result indicating that the gray level difference is equivalent to or larger than the threshold Diff_Th, and a bit 0 may be the comparing result indicating that the gray level difference is less than the threshold Diff_Th. The R sub-pixel hit counter 703, the G sub-pixel hit counter 704 and the B sub-pixel hit counter 705 may respectively count the number of times that the comparing result indicates that the gray level difference is equivalent to or larger than the threshold Diff_Th, and respectively output counter values R_Cnt, G_Cnt and B_Cnt. For example, when the gray level difference between an R subpixel of a horizontal line of the frame N and the average R subpixel data of the horizontal line of the frame N−1 is equivalent to or larger than the threshold Diff_Th, the enable signal R_En enables the R sub-pixel hit counter 703 to add 1 into the counter value R_Cnt. The R sub-pixel hit counter 703, the G sub-pixel hit counter 704 and the B sub-pixel hit counter 705 may be reset to zero before starting counting for a next horizontal line. Therefore, the counter value (R_Cnt, G_Cnt or B_Cnt) may be also regarded as a kind of comparing result with respect to image data of subpixels of a horizontal line, presented by the counter value instead of accumulated gray level differences.

The decision circuit 706 receives the counter values R_Cnt, G_Cnt and B_Cnt and outputs a decision signal Comp_EN, such as a bit 0 or 1, to the control signal generation circuit 522. The decision signal Comp_EN may be generated based on various determinations. In an embodiment, the decision circuit 706 determines whether a specific one of the counter values (which may be associated with a subpixel color which is given more concern), or anyone of the counter values, reaches a counting threshold Cnt_Th. In another embodiment, the decision circuit 706 determines whether all of the counter values reach a counting threshold (or respective counting thresholds). When one or all of the counter values reach or exceed the counting threshold Cnt_Th, the decision circuit 706 output a bit 1 as the decision signal Comp_EN to the control signal generation circuit 522; otherwise, the decision circuit 706 output a bit 0 as the decision signal Comp_EN to the control signal generation circuit 522.

From the above, the decision signal Comp_EN is as the output of the gray level analysis circuit 521 and is with respect to a horizontal line. The decision signal Comp_EN indicates whether a gray level difference between image data corresponding to a horizontal line (a target horizontal line) of the frame N and image data corresponding to the horizontal line of the frame N−1 is significant to result in the symptom of FIG. 4A or 4B. Therefore, the decision signal Comp_EN may be also regarded as a kind of comparing result with respect to image data of a horizontal line, presented by a bit 0 or 1, instead of the counter value or accumulated gray level differences.

The control signal generation circuit 522 may select a configuration of a normal state or a configuration of a compensation state (which is a compensation process for the luminance drop or over-brightness when frame transition) according to the decision signal Comp_EN. The configuration of the normal state may include any one (or more) of a pulse width setting of the gate clock signal, CLK_Normal, a pulse width setting of the initialization clock signal, INT_Normal, and a voltage level setting of the initialization voltage VINT_Normal. The configuration of the compensation state may include any one (or more) of a pulse width setting of the gate clock signal, CLK Comp, a pulse width setting of the initialization clock signal, INT_Comp, and a voltage level setting of the initialization voltage VINT_Comp. If the decision signal Comp_EN=0 the control signal generation circuit 522 selects a configuration of the normal state to be as a control signal output to the timing control circuit 510 or to the voltage regulator 550; and if the decision signal Comp_EN=1 (which indicates there is significant gray level difference between image data of a horizontal line of two adjacent frames which results in luminance drop or luminance over-brightness), the control signal generation circuit 522 selects the configuration of the compensation state to be as the control signal output to the timing control circuit 510 or to the voltage regulator 550. The control signal output by the control signal generation circuit 522 may include one or more of control signals INT_CTRL, CLK_CTRL, and VINT_CTRL, wherein the control signals INT_CTRL and CLK_CTRL are output to the timing control circuit 510, and the control signal VINT_CTRL is output to the voltage regulator 550. Signals INT_SET, CLK_SET, VINT_SET in FIG. 7 may be used for determining whether a driving control signal (CLK or INT) or the initialization voltage V_INT is configured to use the configuration of the compensation state. Values of signals INT_SET, CLK_SET, VINT_SET may additionally determine how long the configuration of the compensation state is to be applied.

Figure 8:
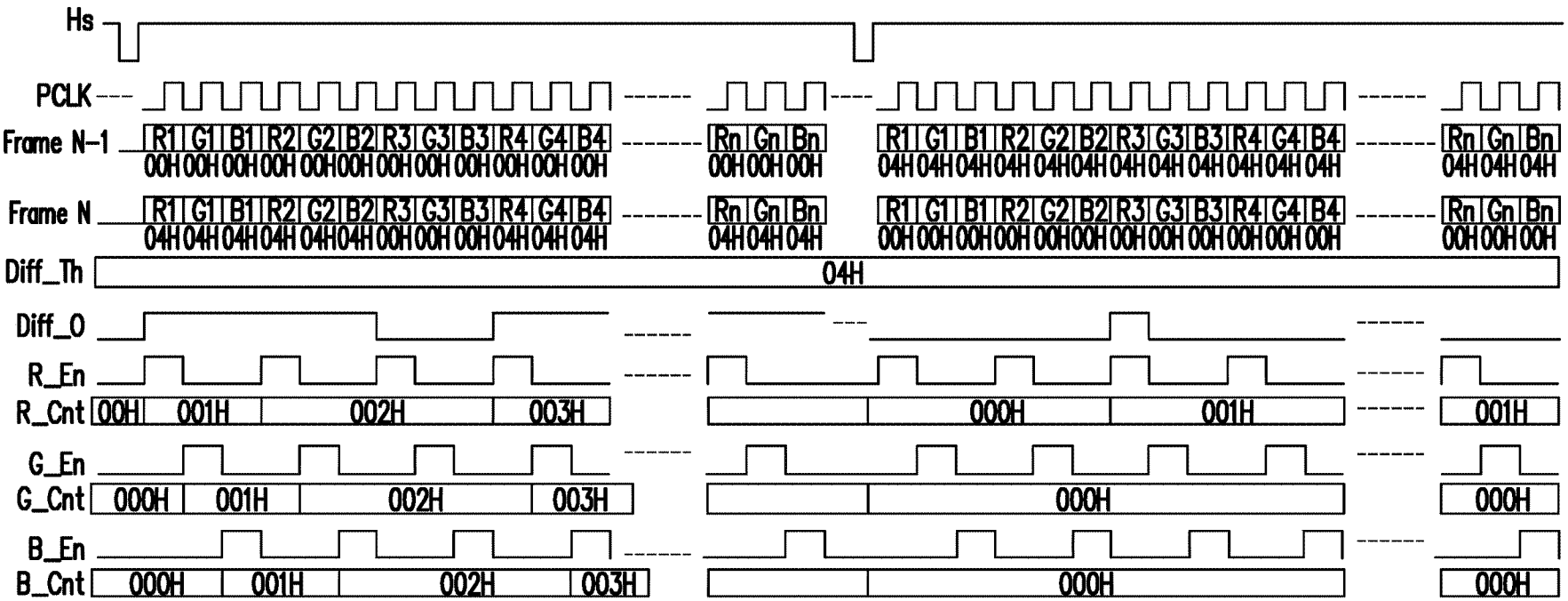
FIG. 8 is a timing sequence diagram illustrating signals in FIG. 7 according to an embodiment of the present invention.

FIG. 8 is a timing sequence diagram illustrating signals in FIG. 7 according to an embodiment of the present invention. In the example of FIG. 8, PCLK is a pixel clock signal, Hs is the horizontal synchronization signal, the average input data of subpixels of a horizontal line of the frame N−1 is 0 (00H), and the average input data of subpixels of the next horizontal line of the frame N−1 is 4 (04H). Diff_Th is set to 4 (04H), and Diff_O is the comparing result output by the comparator 702. The R subpixel hit counter 703, G subpixel hit counter 704 and B subpixel hit counter 705 are sequentially enabled by the enable signals R_En, G_En and B_En so as to output the counter values R_Cnt, G_Cnt and B_Cnt.

Figure 9:
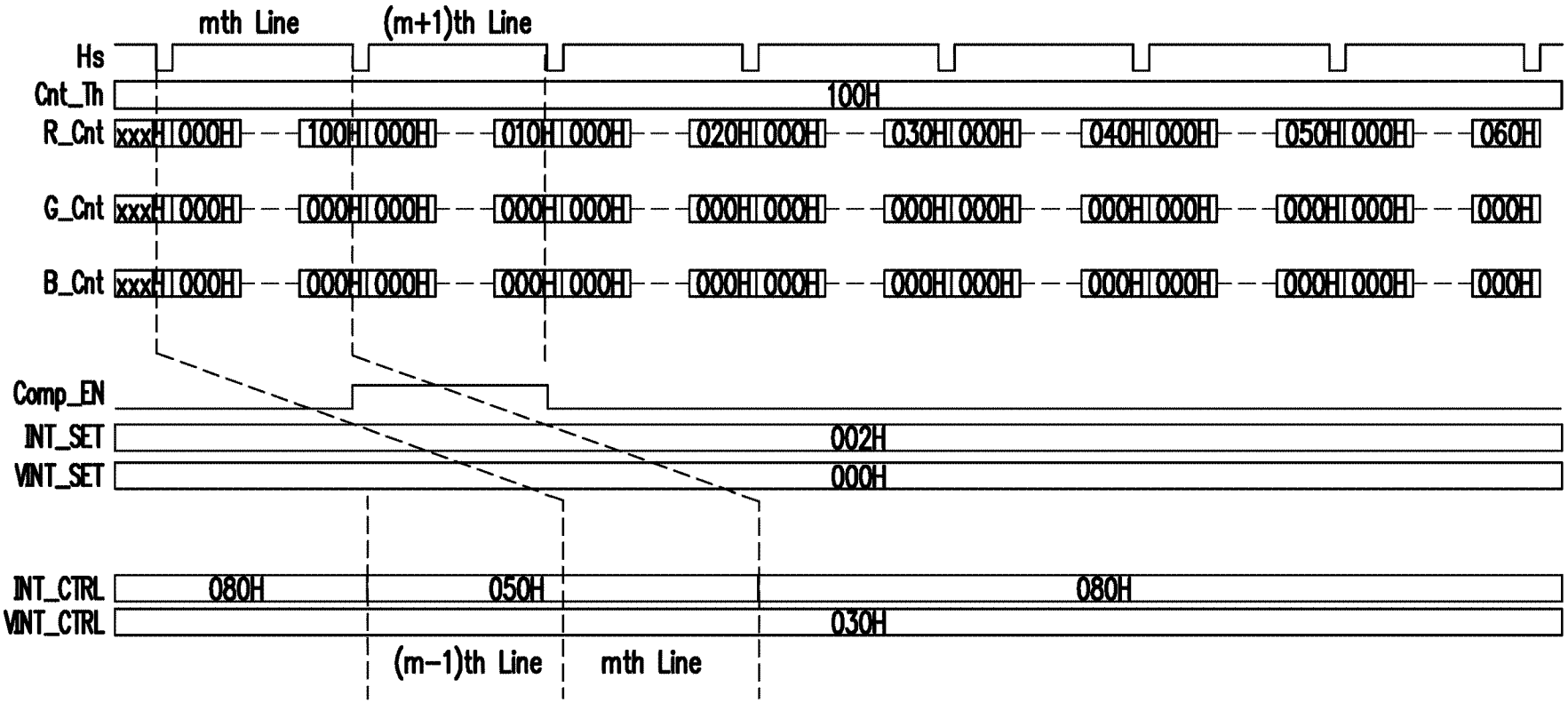
FIG. 9 is a timing sequence diagram illustrating signals in FIG. 7 according to another embodiment of the present invention.

FIG. 9 is a timing sequence diagram illustrating signals in FIG. 7 according to another embodiment of the present invention. In this case, the decision signal Comp_EN=1 as long as the gray level difference with respect to any one color is large enough. The counting threshold Cnt_Th is set to 100 (100H). It can be seen that the decision signal Comp_EN is pulled high to "1" in response to the counter value R_Cnt has reached the counting threshold Cnt_Th after the data of an entire m-th horizontal line has been processed. In FIG. 9, the signal INT_SET set to 2 (02H)

indicates two horizontal line periods, which is the duration the pulse width setting of the initialization clock signal, INT_Comp, is to be applied. If the signal INT_SET=01 instead, the duration that the pulse width setting of the initialization clock signal is to be applied is one horizontal line period. If the signal INT_SET=00, it means the initialization clock signal INT use the configuration of the normal state. Therefore, when the decision signal Comp_EN=1, the control signal INT_CTRL is changed from the original value 80 which is the pulse width setting of the initialization clock signal for the normal state to the new value 50 which is the pulse width setting of the initialization clock signal for the compensation state. The control signal INT_CTRL is output to the timing control circuit 510. The timing control circuit 510 can set up the pulse width of the initialization clock signal INT based on INT_CTRL=50 during the (m−1)-th horizontal line period and maintain the reduced pulse width setting for two horizontal line periods.

The driving apparatus 500 descripted in FIG. 5 and FIG. 7 may be used for driving a display panel in which a gate scan signal $SCAN_i$ and an initialization scan signal $INIT_i$ are applied to control all of pixel circuits of a horizontal line. In the above exemplary description of the gray level analysis circuit 521, the decision circuit 706 processes input information (R_Cnt, G_Cnt, N_Cnt) line by line, so that the decision signal Comp_EN represents a gray level analysis result with respect to image data of a horizontal line. Correspondingly, the timing control circuit 510 sets up the pulse width of the driving control signal or the level of the initialization voltage according to the setting configured to a horizontal line, and as a result the pulse width of the first driving control signal "in a first horizontal line period" may be different from the pulse width of the second driving control signal "in a second horizontal line period", or the first voltage level of the initialization voltage in a first horizontal line period may be different from a second voltage level that the initialization voltage is configured to have in a second horizontal line period. However, if based on another display panel design, the driving apparatus 500 may also be used for driving that display panel.

For example, the driving apparatus 500 may be used for driving a display panel in which multiple gate scan signals and multiple initialization scan signals are applied to control a horizontal line, wherein a horizontal line is divided into two or more pixel circuit groups and one of the gate scan signals and one of the initialization scan signals controls one of the pixel circuit groups of the horizontal line. In such a case, the gray level analysis may be not line-by-line performed and may be group-by-group performed. The decision circuit 706 processes input information (R_Cnt, G_Cnt, N_Cnt) group by group, so that the decision signal Comp_EN represents a gray level analysis result with respect to image data of one of pixel circuit groups of a horizontal line, instead of image data of an entire horizontal line. Correspondingly, the timing control circuit 510 sets up the pulse width of the driving control signal or the level of the initialization voltage according to the setting configured to a pixel circuit group (instead of a horizontal line), and as a result the pulse width of the first driving control signal "in a first display period" may be different from the pulse width of the second driving control signal "in a second display period", or the first voltage level of the initialization voltage "in a first display period" may be different from a second voltage level that the initialization voltage is configured to have "in a second display period". Herein, the term "display period" may be identical to the horizontal line period defined by the period of the horizontal synchronization signal, or may have a time length different from the horizontal line period. For example, a display period may be less than a horizontal line period.

Driving control signals (CLK1 to CLK4, INT1 to INT4, and EM_CLK1 to EM_CLK4) illustrated in the following FIGS. 10 and 12-20 are applied to the gate driving circuit 51 for driving the OLED panel with p-type TFTs (e.g. using the OLED pixel circuit described in FIG. 2A). Vs is a vertical synchronization signal and Hs is the horizontal synchronization signal. The period of the horizontal synchronization signal is a horizontal line period. For driving the OLED panel with p-type TFTs, the driving control signals (CLK, INT, EM_CLK) output by the driving apparatus 500 and the driving control signals (SCAN, INIT, EM) output by the gate driving circuit 51 are active low. For driving the OLED panel with n-type TFTs, the driving control signals output by the driving apparatus 500 and by the gate driving circuit 51 are active high, which are not depicted in the figures and can be derived in a similar behavior.

Figure 10:
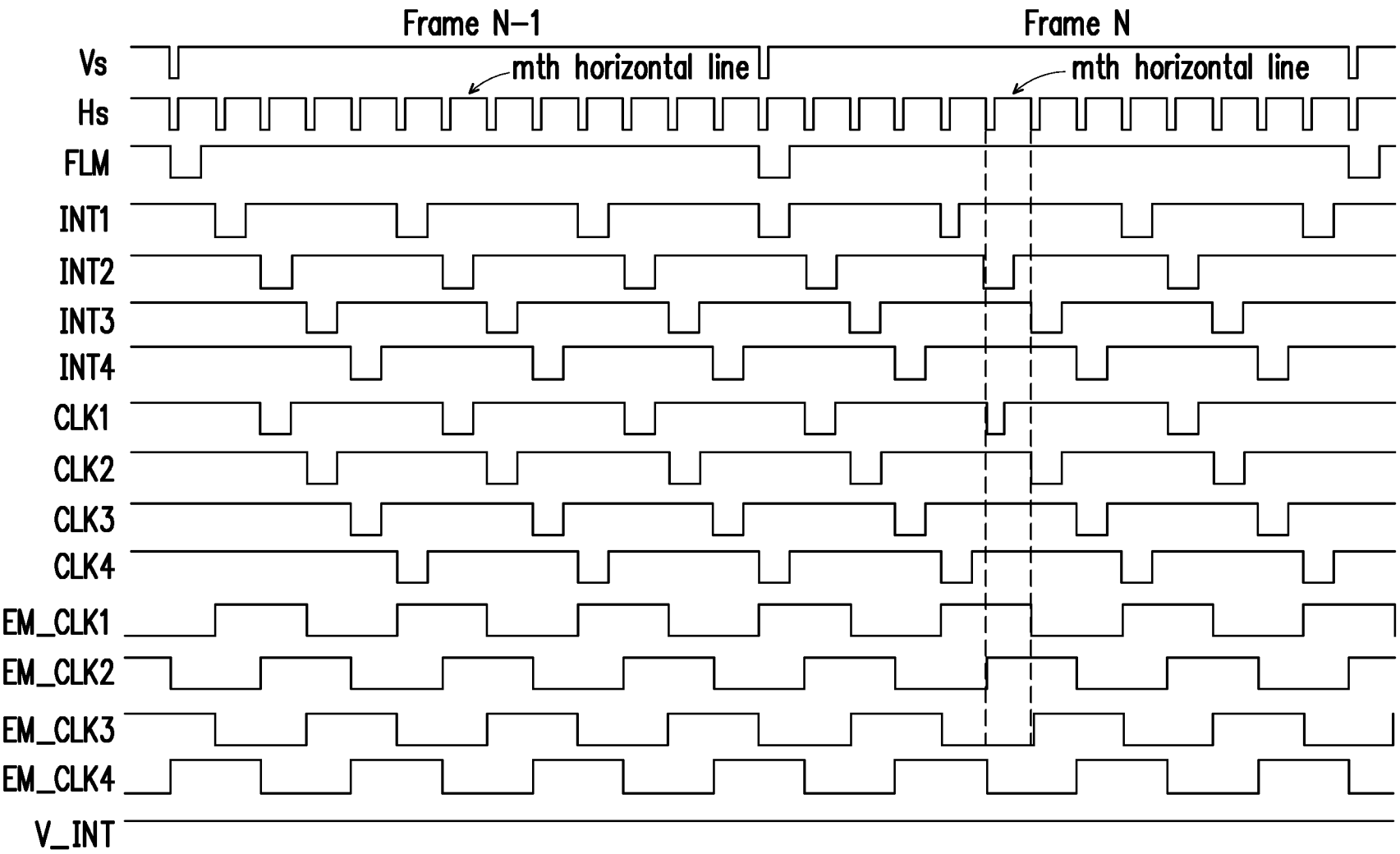
FIG. 10 is a timing sequence diagram of the driving control signals output by the driving apparatus according to an embodiment of the present invention.

FIG. 10 is a timing sequence diagram of the driving control signals output by the driving apparatus 500 according to an embodiment of the present invention. In the embodiment illustrated in FIG. 10, image data (i.e. gray level values) corresponding to the OLED pixel circuits of m-th horizontal line in the changes from a low gray level to a high gray level between the frame N−1 and the frame N, which is detected by the compensation circuit 520. Based on the said operation of the compensation circuit 520 and the timing control circuit 510, the driving apparatus 500 may configure the reduced (smaller) pulse width for the gate clock signal CLK1 during the m-th horizontal line period, and configure the reduced (smaller) pulse width for the initialization clock signal INT1 during the (m−1)-th horizontal line period (since the initialization stage of the OLED pixel circuits of the m-th horizontal line is performed during the (m−1)-th horizontal line period). Correspondingly, the pulse width of the initialization scan signal $INIT_m$ of the m-th horizontal line and the pulse width of the gate scan signal $SCAN_m$ of the m-th horizontal line are configured to be a pulse width less than it should be in the normal state.

Figure 11:
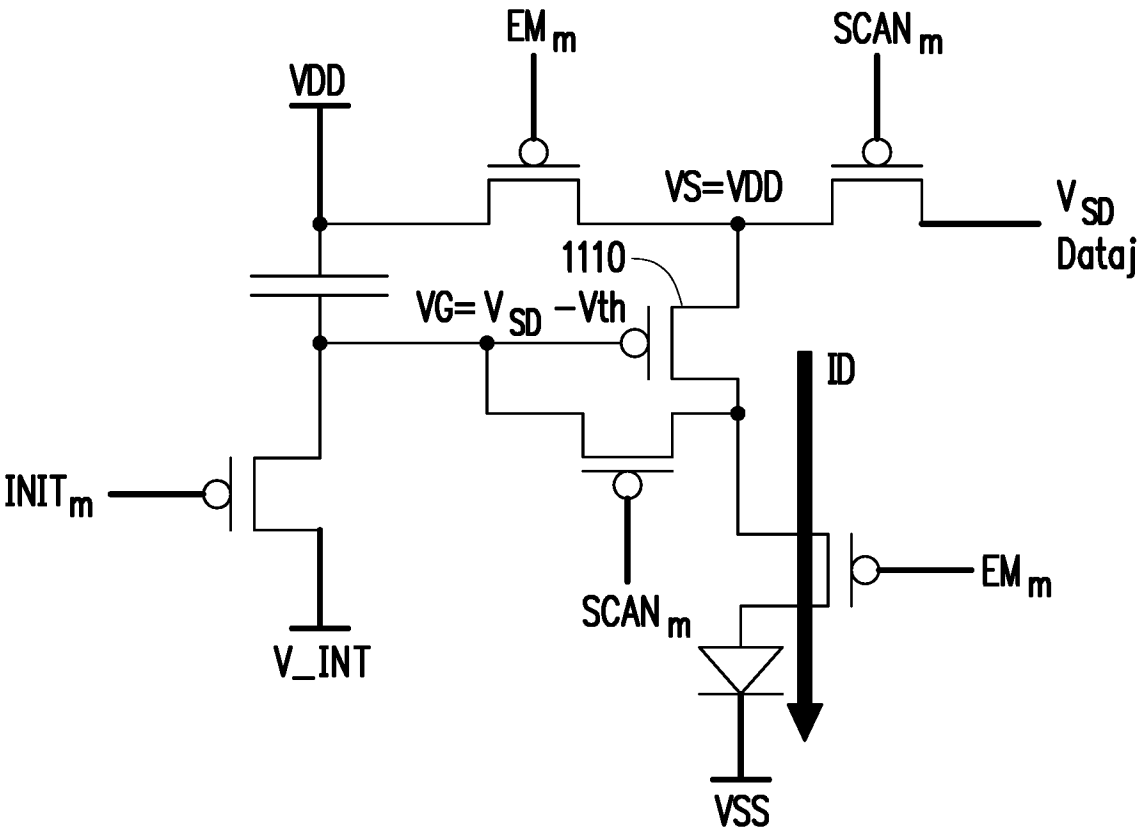
FIG. 11 is a schematic circuit block diagram of an OLED pixel circuit in the OLED pixel array of FIG. 5 according to an embodiment of the present invention.

FIG. 11 is a schematic circuit block diagram of an OLED pixel circuit in the OLED pixel array 52 of FIG. 5 according to an embodiment of the present invention. Details with respect to the OLED pixel circuit in FIG. 11 may be inferred with reference to the OLED pixel circuit illustrated in FIG. 2A and thus, will not be repeated. When the pulse width of the gate clock signal CLK1 in the m-th horizontal line period of the N-th frame period (corresponding to the frame N) is configured to have a reduced pulse width, the pulse width of the gate scan signal $SCAN_m$ generated based on the gate clock signal CLK1 (by the gate driving circuit 51) is relatively reduced, so that the voltage $V_{SD}$ at the data input terminal illustrated in FIG. 11 becomes stable relatively quickly. When the voltage $V_{SD}$ reaches the steady state, the level of the voltage $V_{SD}$ is lower than an normal data input terminal level when the gate clock signal CLK1 is configured to have a normal pulse width, such that the level of the gate electrode voltage VG (=$V_{SD}$−Vth) of the driving TFT 1110 is smaller than an normal gate electrode voltage level when the gate clock signal CLK1 is configured to have a normal pulse width. When in the emission stage of the OLED pixel circuit, the gate-source voltage VSG of the driving TFT 1110 which is a voltage difference between the source electrode voltage VS and the gate electrode voltage VG, VSG=VDD−VG, increase, causing a driving current ID to increase and the luminance of the OLED increases, which compensates for the luminance drop in the first frame which displays high gray level.

The compensation circuit 520 illustrated in FIG. 7 can be used in a driving apparatus for driving an OLED display panel no matter p-type TFTs or n-type TFTs are used in the pixel driving circuit, and the timing control circuit 510 may set up, in a way similar to the illustrated in FIG. 10, the reduced pulse width of the driving control signal (where the driving control signals are active high), CLK and INT, output to the gate driving circuit 51. Thus, the driving current through a driving TFT (referred to T1 in the OLED pixel circuit 112*b* of FIG. 2B) may be reduced by the gate scan signal SCAN or the initialization scan signal INIT which has the reduced pulse width. In such a way, the luminance over-brightness in the first frame (frame N) which displays low gray level as illustrated in FIG. 4B may be compensated, and the m-th horizontal line in the frame N can have the ideal emission luminance as dark as the expected.

Figure 12:
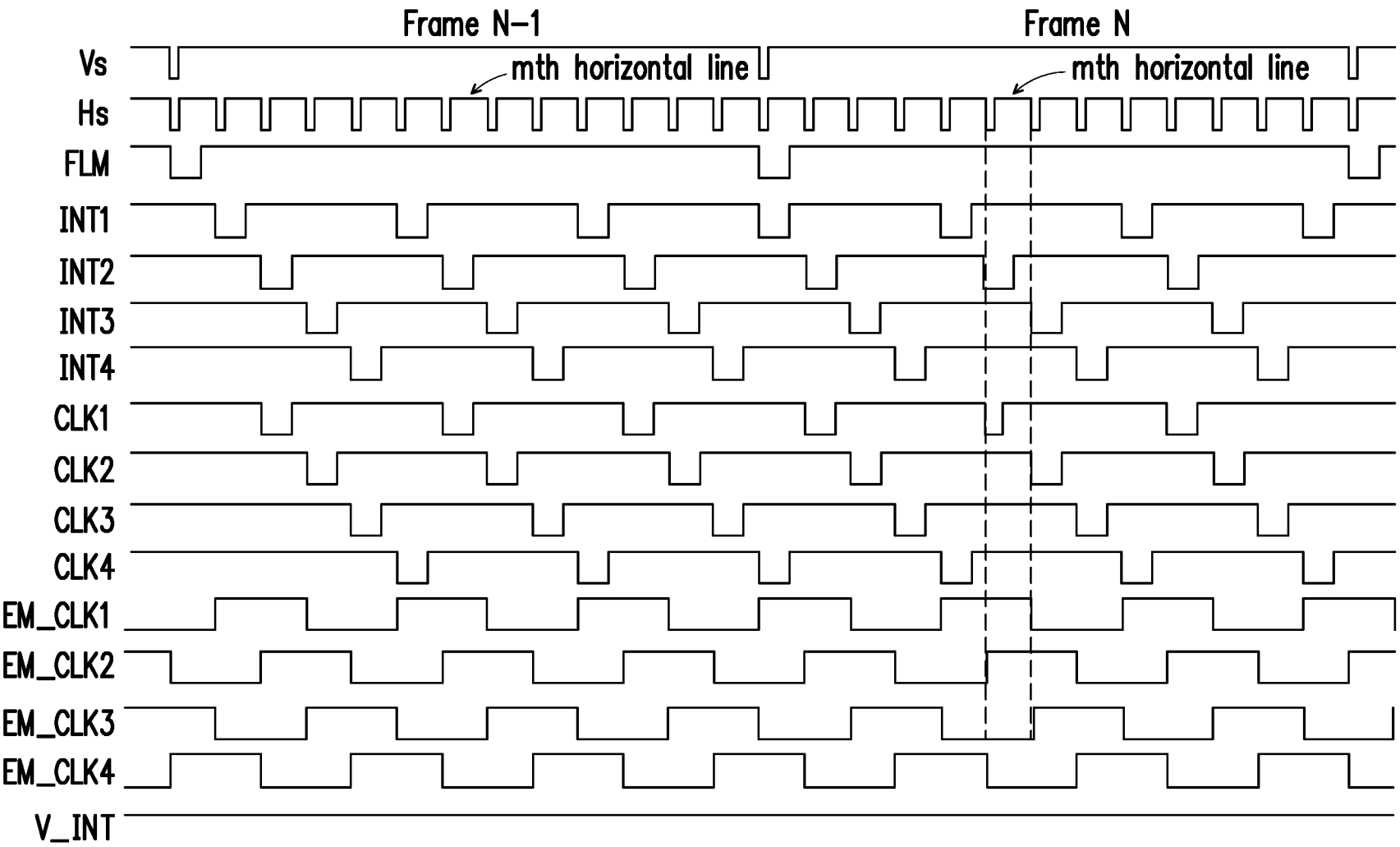
FIG. 12 is a timing sequence diagram of the driving control signals output by the driving apparatus according to another embodiment of the present invention.

FIG. 12 is timing sequence diagram of the driving control signals output by the driving apparatus 500 according to another embodiment of the present invention. In the embodiment illustrated in FIG. 12, image data (i.e. gray level values) corresponding to the OLED pixel circuits of m-th horizontal line in the changes from a low gray level to a high gray level between the frame N−1 and the frame N, which is detected by the compensation circuit 520. Based on the said operation of the compensation circuit 520 and the timing control circuit 510, the driving apparatus 500 may configure the reduced (smaller) pulse width for the gate clock signal CLK1 during the m-th horizontal line period and configure the normal pulse width for the initialization clock signal INT1 during the (m−1)-th horizontal line period. Correspondingly, the pulse width of the gate scan signal $SCAN_m$ of the m-th horizontal line is configured to be a pulse width less than it should be in the normal state. According to the pulse width configuration of FIG. 12, the driving apparatus 500 can have the effect of compensating for the luminance drop as described in FIG. 11.

Figure 13:
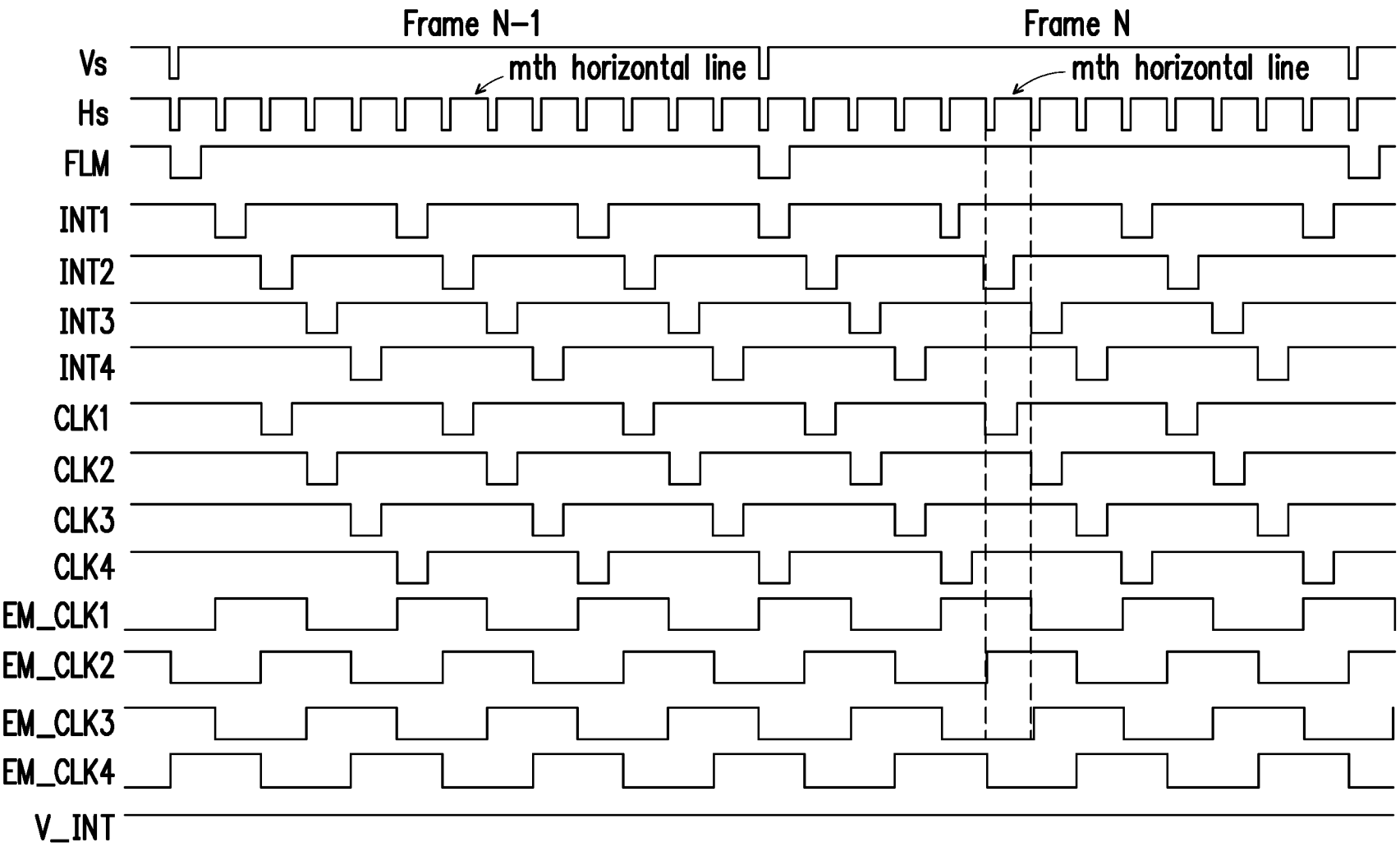
FIG. 13 is a timing sequence diagram of the driving control signals output by the driving apparatus according to another embodiment of the present invention.

FIG. 13 is a timing sequence diagram of the driving control signals output by the driving apparatus 500 according to another embodiment of the present invention. In the embodiment illustrated in FIG. 13, image data (i.e. gray level values) corresponding to the OLED pixel circuits of m-th horizontal line in the changes from a low gray level to a high gray level between the frame N−1 and the frame N, which is detected by the compensation circuit 520. Based on the said operation of the compensation circuit 520 and the timing control circuit 510, the driving apparatus 500 may configure the normal pulse width for the gate clock signal CLK1 during the m-th horizontal line period and configure the reduced (smaller) pulse width for the initialization clock signal INT1 during the (m−1)-th horizontal line period. Correspondingly, the pulse width of the initialization scan signal $INIT_m$ of the m-th horizontal line is configured to be a pulse width less than it should be in the normal state. According to the pulse width configuration of FIG. 13, the driving apparatus 500 can have the effect of compensating for the luminance drop.

Figure 14:
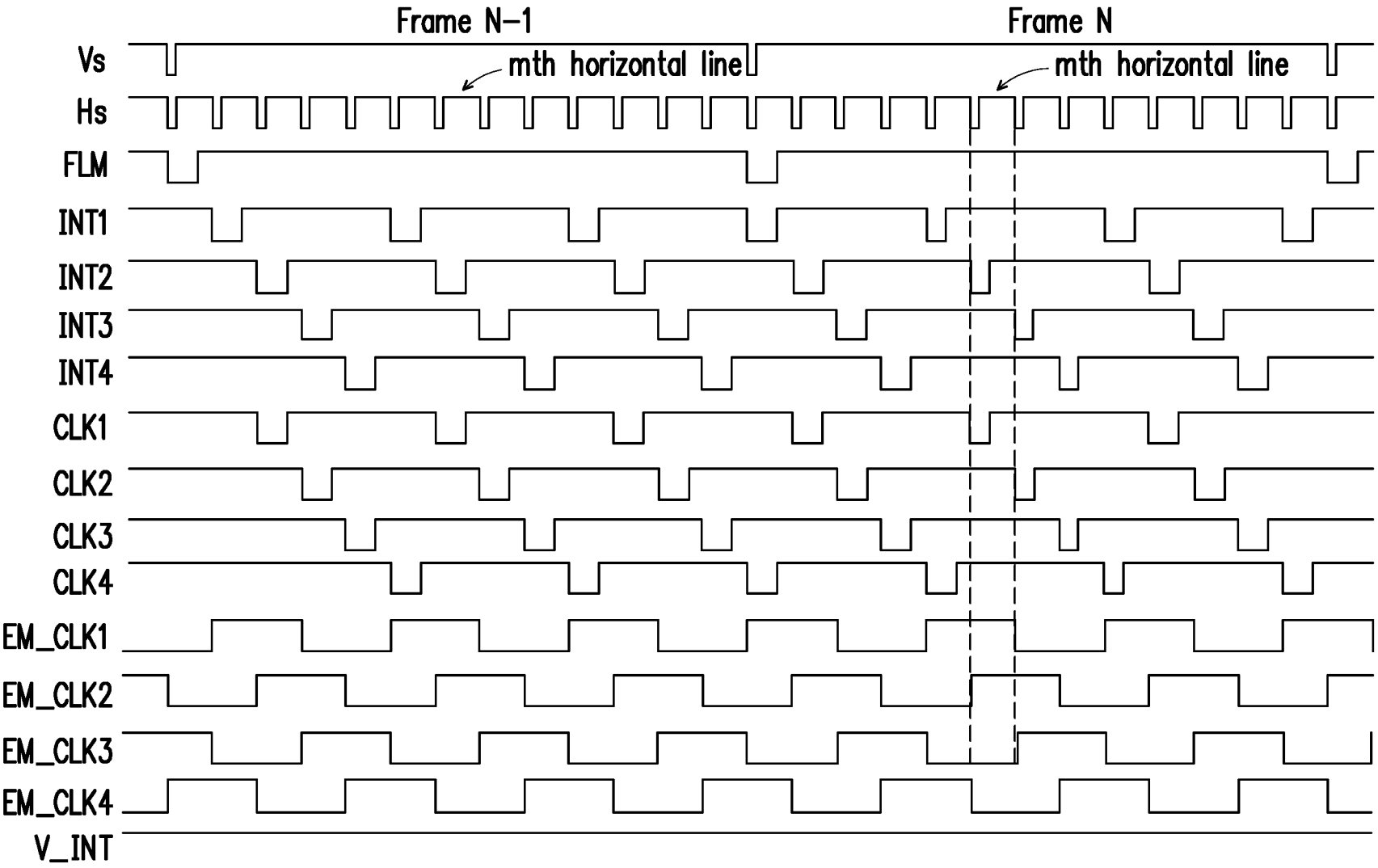
FIG. 14 is a timing sequence diagram of the driving control signals output by the driving apparatus according to another embodiment of the present invention.

FIG. 14 is a timing sequence diagram of the driving control signals output by the driving apparatus 500 according to another embodiment of the present invention. In the embodiment illustrated in FIG. 14, image data (i.e. gray level values) corresponding to the OLED pixel circuits of m-th horizontal line in the changes from a low gray level to a high gray level between the frame N−1 and the frame N, which is detected by the compensation circuit 520. Based on the said operation of the compensation circuit 520 and the timing control circuit 510, the driving apparatus 500 may configure the reduced (smaller) pulse width for the gate clock signals, including CLK1 to CLK4, during a duration form the m-th horizontal line period to the (m+3)-th horizontal line period, and configure the reduced (smaller) pulse width for the initialization clock signals, including INT1 to INT4, during a duration from the (m−1)-th horizontal line period to the (m+2)-th horizontal line period. Correspondingly, the pulse width of the initialization scan signals $INIT_m$ to $INIT_{m+3}$ and the pulse width of the gate scan signals $SCAN_m$ to $SCAN_{m+3}$ are configured to be a pulse width less than it should be in the normal state. According to the pulse width configuration of FIG. 14, the driving apparatus 500 can have the effect of compensating for the luminance drop.

Figure 15:
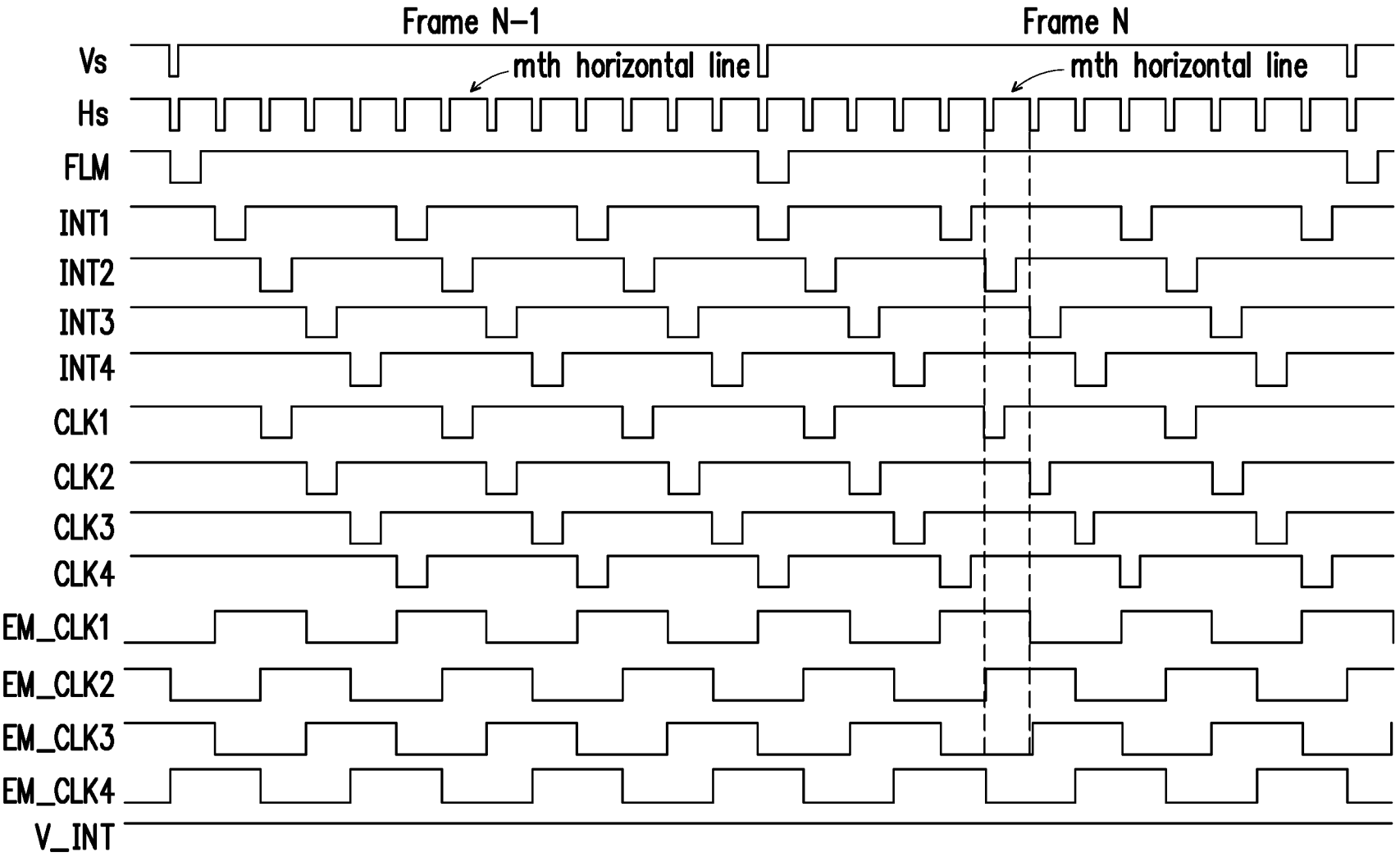
FIG. 15 is a timing sequence diagram of the driving control signals output by the driving apparatus according to an embodiment of the present invention.
Figure 16:
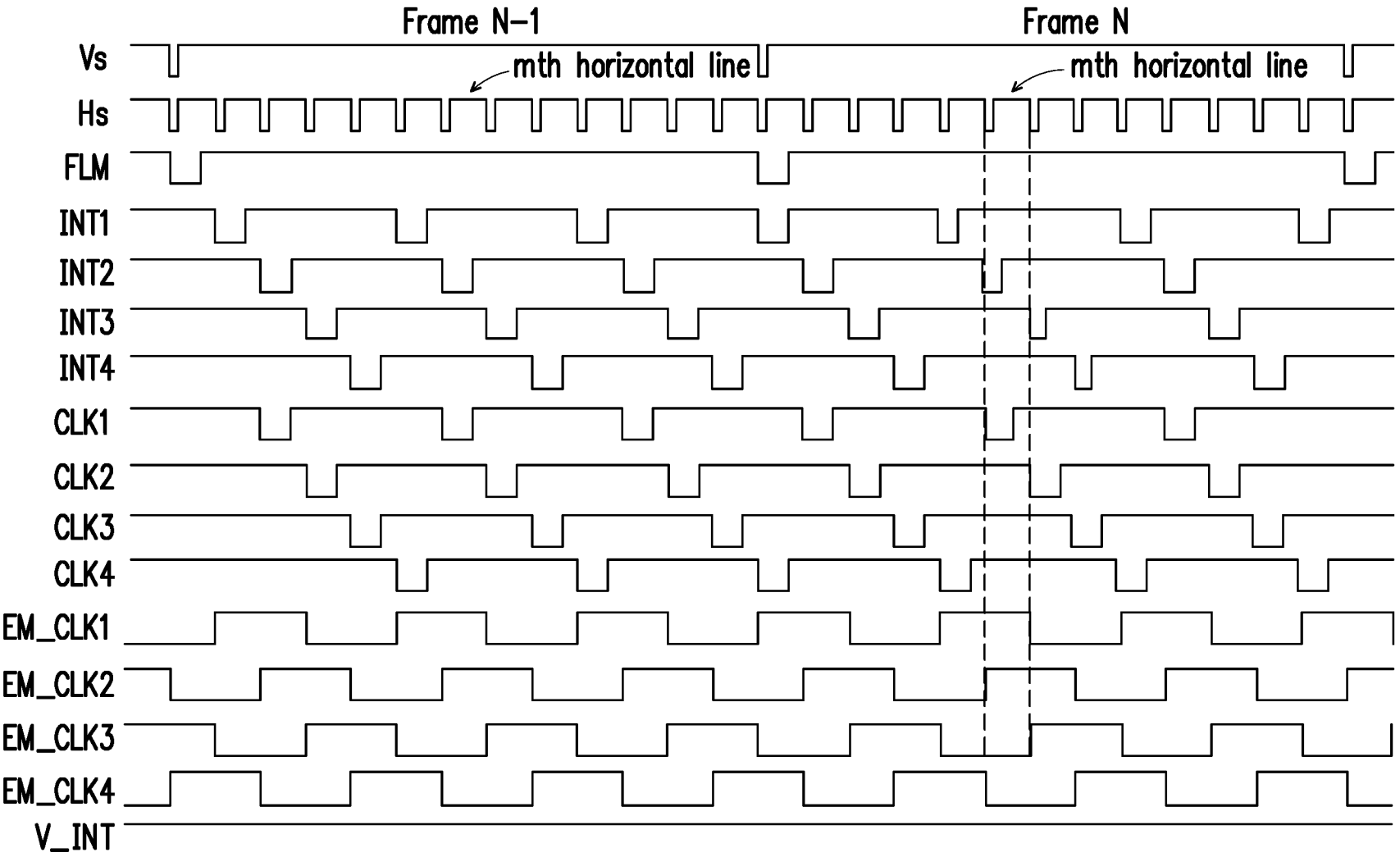
FIG. 16 is a timing sequence diagram of the driving control signals output by the driving apparatus according to an embodiment of the present invention.

FIG. 15 is a timing sequence diagram of the driving control signals output by the driving apparatus 500 according to an embodiment of the present invention. FIG. 15 illustrates only the gate clock signals CLK1 to CLK4 are configured to have the reduced pulse width and the initialization clock signals INT1 to INT4 are configured to have the normal pulse width. Correspondingly, the pulse width of the gate scan signals $SCAN_m$ to $SCAN_{m+3}$ are configured to be a pulse width less than it should be in the normal state. FIG. 16 is a timing sequence diagram of the driving control signals output by the driving apparatus 500 according to an embodiment of the present invention. FIG. 16 illustrates only the initialization clock signals INT1 to INT4 are configured to have the reduced pulse width and the gate clock signals CLK1 to CLK4 are configured to have the normal pulse width. Correspondingly, the pulse width of the initialization scan signals $INIT_m$ to $INIT_{m+3}$ are configured to be a pulse width less than it should be in the normal state.

Figure 17:
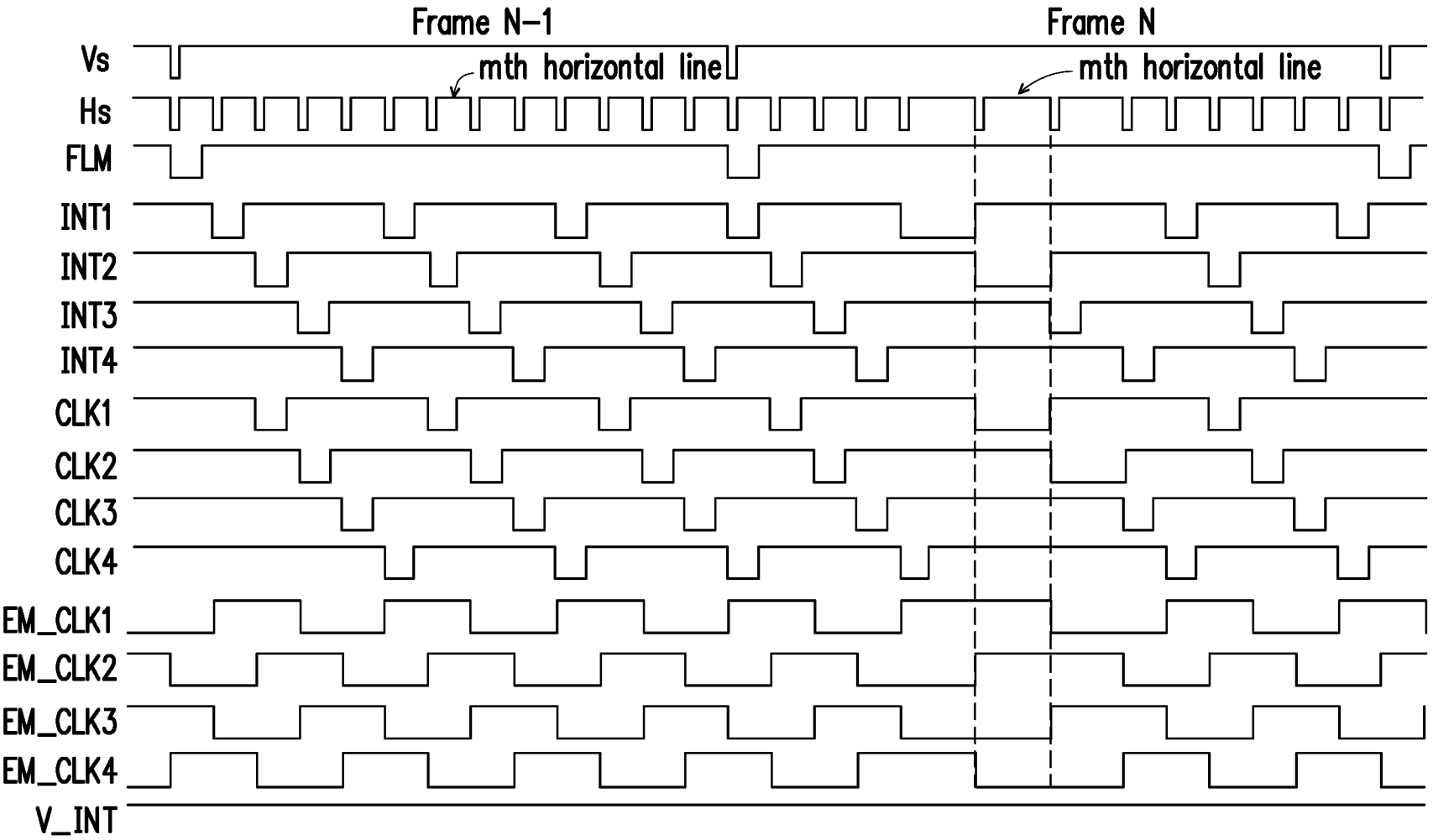
FIG. 17 is a timing sequence diagram of the driving control signals output by the driving apparatus according to another embodiment of the present invention.

FIG. 17 is a timing sequence diagram of the driving control signals output by the driving apparatus 500 according to another embodiment of the present invention. In the embodiment of FIG. 17, the period of the horizontal synchronization signal Hs are adjustable and may be generated by the driving apparatus 500 itself. In the embodiment illustrated in FIG. 17, image data (i.e. gray level values) corresponding to the OLED pixel circuits of m-th horizontal line in the changes from a low gray level to a high gray level between the frame N−1 and the frame N, which is detected by the compensation circuit 520. In response, the driving apparatus 500 may configure a longer period length (which is greater than a normal horizontal line period) to a duration from the (m−1)-th horizontal line period to the (m+1)-th horizontal line period, configure an increased (greater) pulse width for the gate clock signals CLK1 and CLK2 respectively in the m-th and (m+1)-th horizontal line periods, and configure the increased (greater) pulse width for the initialization clock signals INT1 and INT2 respectively in the (m−1)-th and m-th horizontal line periods. Correspondingly, the pulse width of the initialization scan signals $INIT_m$ of the m-th horizontal line and $INIT_{m+1}$ of the (m+1)-th horizontal line, and the pulse width of the gate scan signals $SCAN_m$ of the m-th horizontal line and $SCAN_{m+1}$ of the (m+1)-th horizontal line are configured to be longer than it should be in the normal state. It is noted that increased pulse width of the driving control signals is applied for how long (e.g., how many horizontal line periods) can be decided by the requirement. According to the pulse width configuration of FIG. 17, the driving apparatus 500 may also have the effect of compensating for the luminance drop, since a longer active pulse width of the driving control signal (which can be the gate clock signal or initialization clock signal) may increase time for the initialization stage and time for the data writing and compensation stage.

Figure 18:
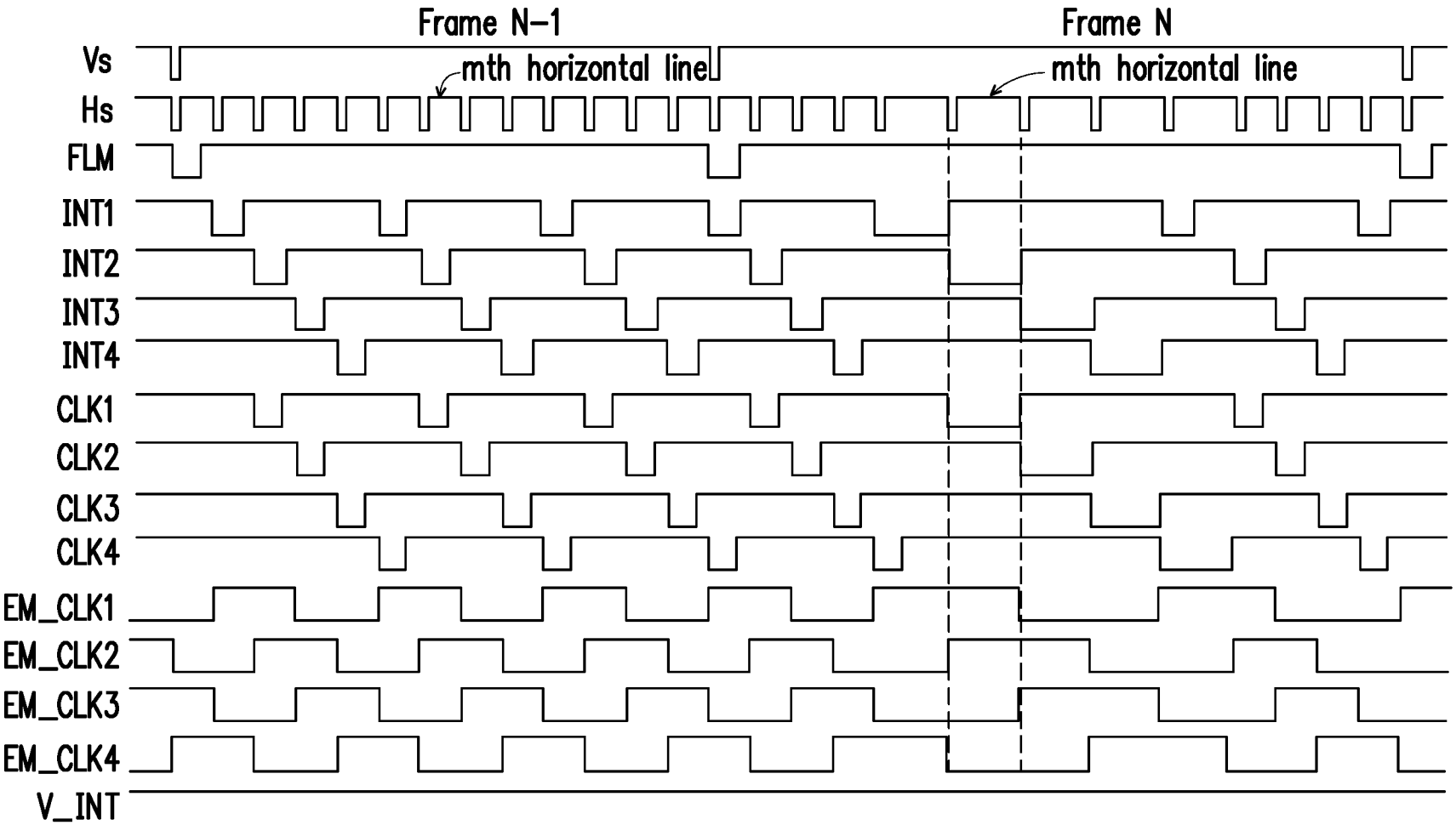
FIG. 18 is a timing sequence diagram of the driving control signals output by the driving apparatus according to another embodiment of the present invention.

FIG. 18 is a timing sequence diagram of the driving control signals output by the driving apparatus 500 according to another embodiment of the present invention. In the embodiment illustrated in FIG. 18, image data (i.e. gray level values) corresponding to the OLED pixel circuits of m-th horizontal line in the changes from a low gray level to a high gray level between the frame N−1 and the frame N, which is detected by the compensation circuit 520. In response, the driving apparatus 500 may configure a longer period length to a duration from the (m−1)-th horizontal line period to the (m+3)-th horizontal line period, and configure the increased pulse width for the gate clock signals CLK1 to CLK4 during a duration from the m-th to (m+3)-th horizontal line periods, and configure the increased pulse width for the initialization clock signals INT1 to INT4 during a duration from the (m−1)-th to (m+2)-th horizontal line periods. Correspondingly, the pulse width of the initialization scan signals $INIT_m$ to $INIT_{m+3}$ and the pulse width of the gate scan signals $SCAN_m$ to $SCAN_{m+3}$ are configured to be longer than it should be in the normal state.

Figure 19:
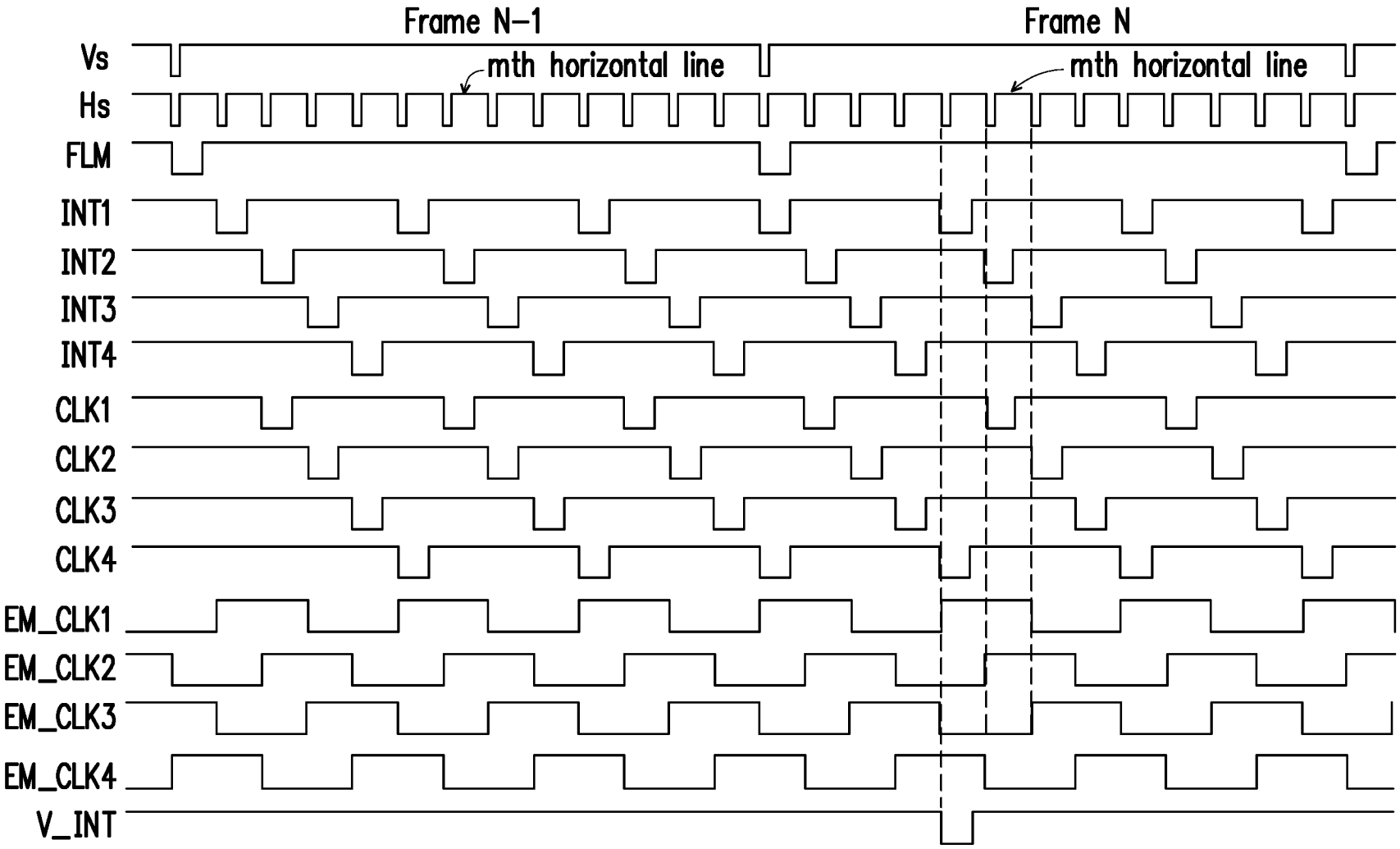
FIG. 19 is a timing sequence diagram of the driving control signals output by the driving apparatus according to another embodiment of the present invention.

FIG. 19 is a timing sequence diagram of the driving control signals and the initialization voltage output by the driving apparatus 500 according to another embodiment of the present invention. In the embodiment illustrated in FIG. 19, image data (i.e. gray level values) corresponding to the OLED pixel circuits of m-th horizontal line in the changes from a low gray level to a high gray level between the frame N−1 and the frame N, which is detected by the compensation circuit 520. In response, the voltage regulator 550 of the driving apparatus 500 sets up a level of the initialization voltage V_INT, which is lower than a normal level, in at least the (m−1)-th horizontal line period (since the initialization stage of the OLED pixel circuits of the m-th horizontal line is performed during the (m−1)-th horizontal line period). For example, the driving apparatus 500 may adjust the initialization voltage V_INT from a normal level (e.g., −2.5V), which is applied in (m−2)-th horizontal line period, to a lower level (e.g., −3V) in the (m−1)-th horizontal line period, to obtain a quick charge in the initialization stage of the m-th horizontal line, and adjusts the initialization voltage V_INT back to the normal level in the m-th horizontal line period. During the (m−1) horizontal line period, the lower level of initialization voltage lasts for a predetermined length determined according to the pulse width of the initialization clock signal in the (m−1) horizontal line period. Generally, said predetermined length may be the same as the pulse width of the initialization clock signal.

Figure 20:
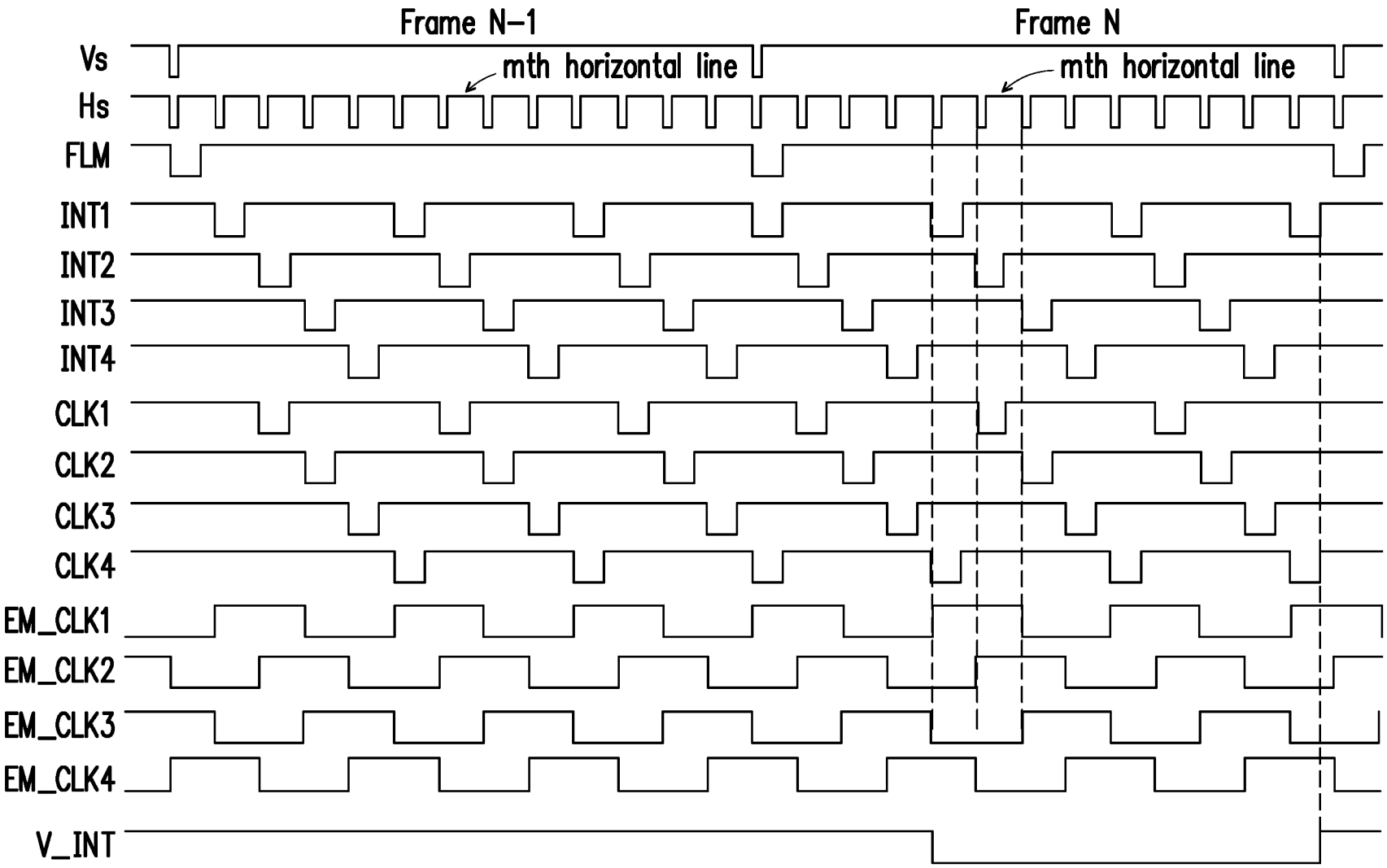
FIG. 20 is a timing sequence diagram of the driving control signals output by the driving apparatus according to another embodiment of the present invention.

FIG. 20 is a timing sequence diagram of the driving control signals output by the driving apparatus 500 according to another embodiment of the present invention. Different from the initialization voltage setting in the FIG. 19, the lower level of initialization voltage V_INT in FIG. 20 may last for a predetermined length longer than a horizontal line period. For example, the lower level of initialization voltage V_INT in FIG. 20 lasts for several horizontal line periods, such as from the (m−1)-th horizontal line period to the last horizontal line period of the frame N. The configuration in FIG. 20 may be more suitable than the configuration in FIG. 19, when the initialization voltage cannot be pulled up back to the normal level in a horizontal line period which is a very short period. It is noted that the lower level (as the configuration of the compensation state) and the normal level (as the configuration of the normal state) output to the OLED pixel array 52 may be provided by only one initialization voltage output which is adjustable, or may be provided by two different constant initialization voltage outputs which can be selected, such as V_INT1 for the normal state and V_INT2 for the compensation state, which is not limited therein.

Figure 21:
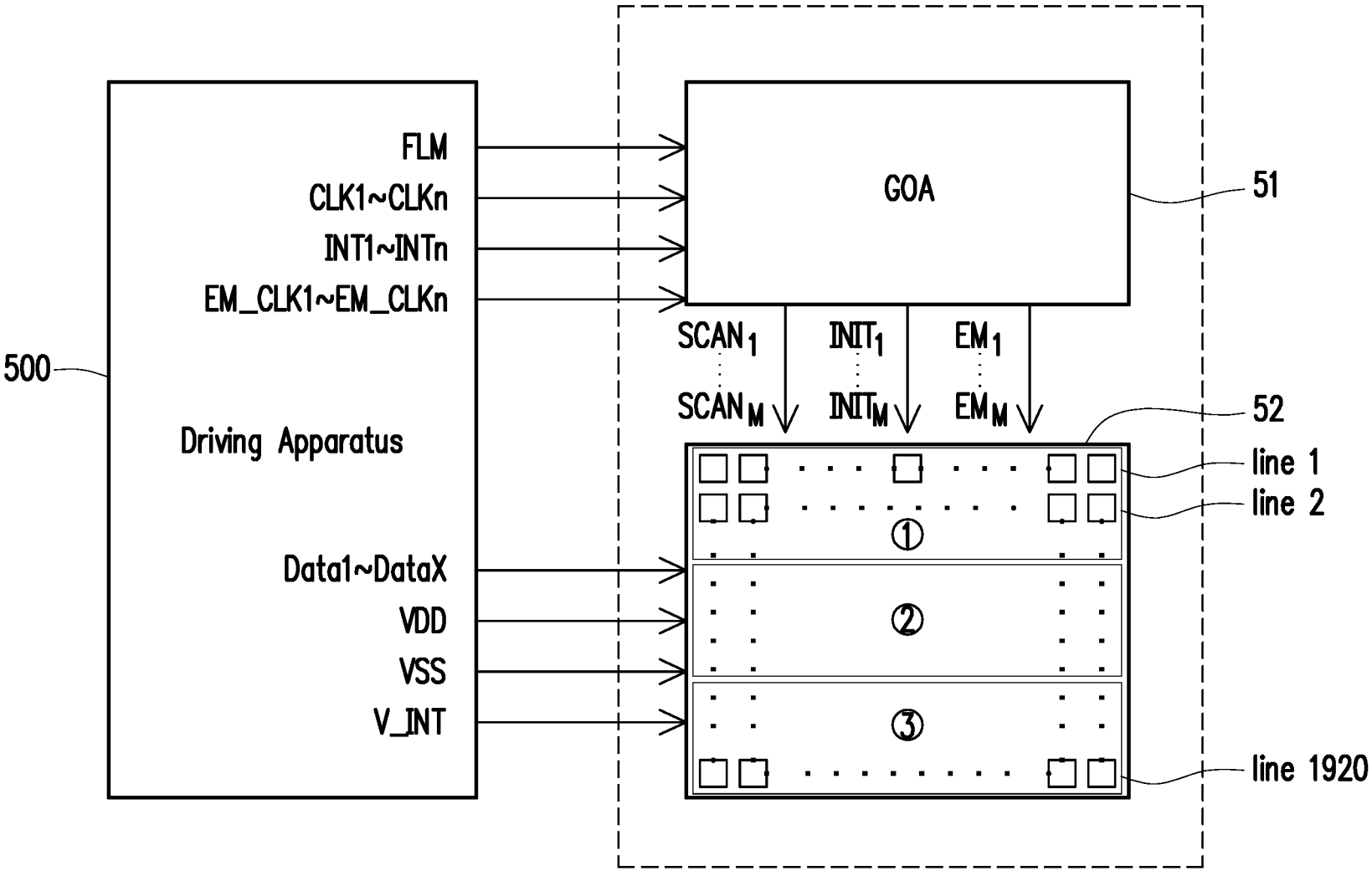
FIG. 21 illustrates a circuit block diagram of an OLED display device according to an embodiment of the present invention.

FIG. 21 illustrates a circuit block diagram of an OLED display device according to an embodiment of the present invention. Details with respect to the driving apparatus 500, the gate driving circuit 51 and the OLED pixel array 52 illustrated in FIG. 21 may be inferred with reference to the descriptions related to the driving apparatus 500, the gate driving circuit 51 and the OLED pixel array 52 illustrated in FIG. 5 and thus, will not be repeated. In the embodiment of FIG. 21, by different areas of the OLED pixel array 52, the driving apparatus 500 can configure different settings (i.e., different pulse widths of the gate clock signals CLK1 to CLKn, different pulse widths of the initialization clock signals INT1 to INTn, or different levels of the initialization voltage V_INT). It is assumed the OLED pixel array 52 includes 1920 horizontal lines. For example, the OLED pixel array 52 is divided into three regions denoted 1, 2 and 3, wherein each region includes a plurality of horizontal lines. The region 1 has a relatively light loading since the horizontal lines of the region 1 are firstly driven, and the region 3 has a relatively heavy loading since the horizontal lines of the region 3 are the last driven.

Figure 22:
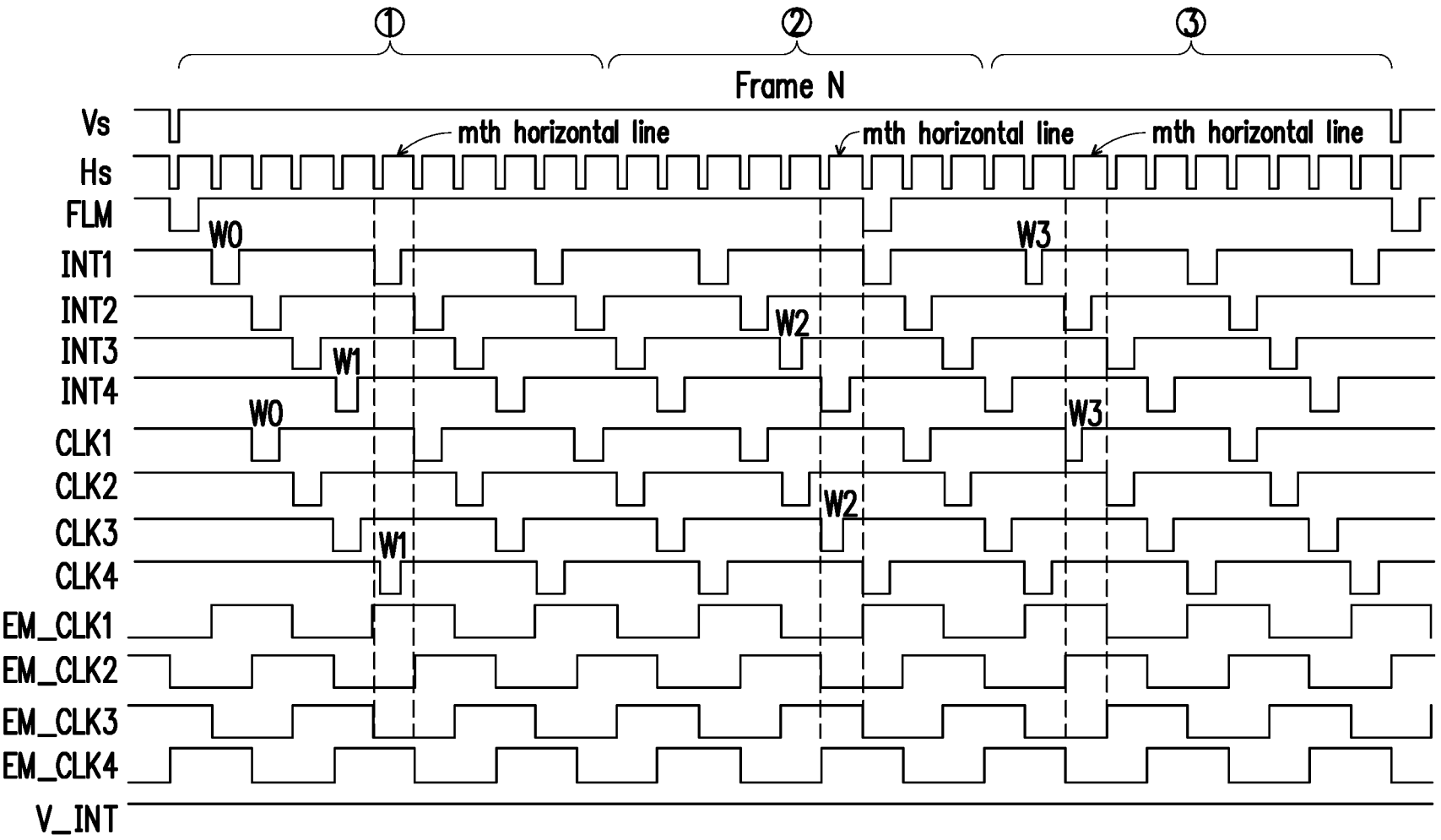
FIG. 22 is a timing sequence diagram of the driving control signals output by the driving apparatus of FIG. 21 according to an embodiment of the present invention.

FIG. 22 is a timing sequence diagram of the driving control signals output by the driving apparatus 500 of FIG. 21 according to an embodiment of the present invention. Details with respect to the embodiment illustrated in FIG. 22 may be inferred with reference to the descriptions related to the embodiments illustrated in FIGS. 10-19 and thus, will not be repeated. According to the embodiment illustrated in FIG. 22, W0 denotes a normal pulse width, and W1, W2, W3 denote different reduced pulse width, wherein W0>W1>W2>W3. If the m-th horizontal line (where the image data changes from a low gray level to a high gray level between the frame N−1 and the frame N) is located in the region 1 of the OLED pixel array 52, the driving apparatus 500 may configure the first reduced pulse width W1 for the gate clock signal CLK4 during the m-th horizontal line period, and configure the first reduced pulse width W1 for the initialization clock signal INT4 during the (m−1)-th horizontal line period. If the m-th horizontal line is located in the region 2 of the OLED pixel array 52, the driving apparatus 500 may configure the second reduced pulse width W2 for the gate clock signal CLK3 during the m-th horizontal line period, and configure the second reduced pulse width W2 for the initialization clock signal INT3 during the (m−1)-th horizontal line period. Or, if the m-th horizontal line is located in the region 3 of the OLED pixel array 52, the driving apparatus 500 may configure the third reduced pulse width W3 for the gate clock signal CLK1 during the m-th horizontal line period, and configure the third reduced pulse width W3 for the initialization clock signal INT1 during the (m−1)-th horizontal line period. That is, the more heavy loading that the region where the m-th horizontal line is located, the more reduced pulse width the driving control signal is configure to have. In another embodiment (not shown in FIG. 22), the voltage level of the initialization voltage V_INT may have different compensation setting for different regions. The more heavy loading that the region where the m-th horizontal line is located, the more lower level the initialization voltage V_INT is configure to have (to make a quick charge in the initialization stage).

Figure 23:
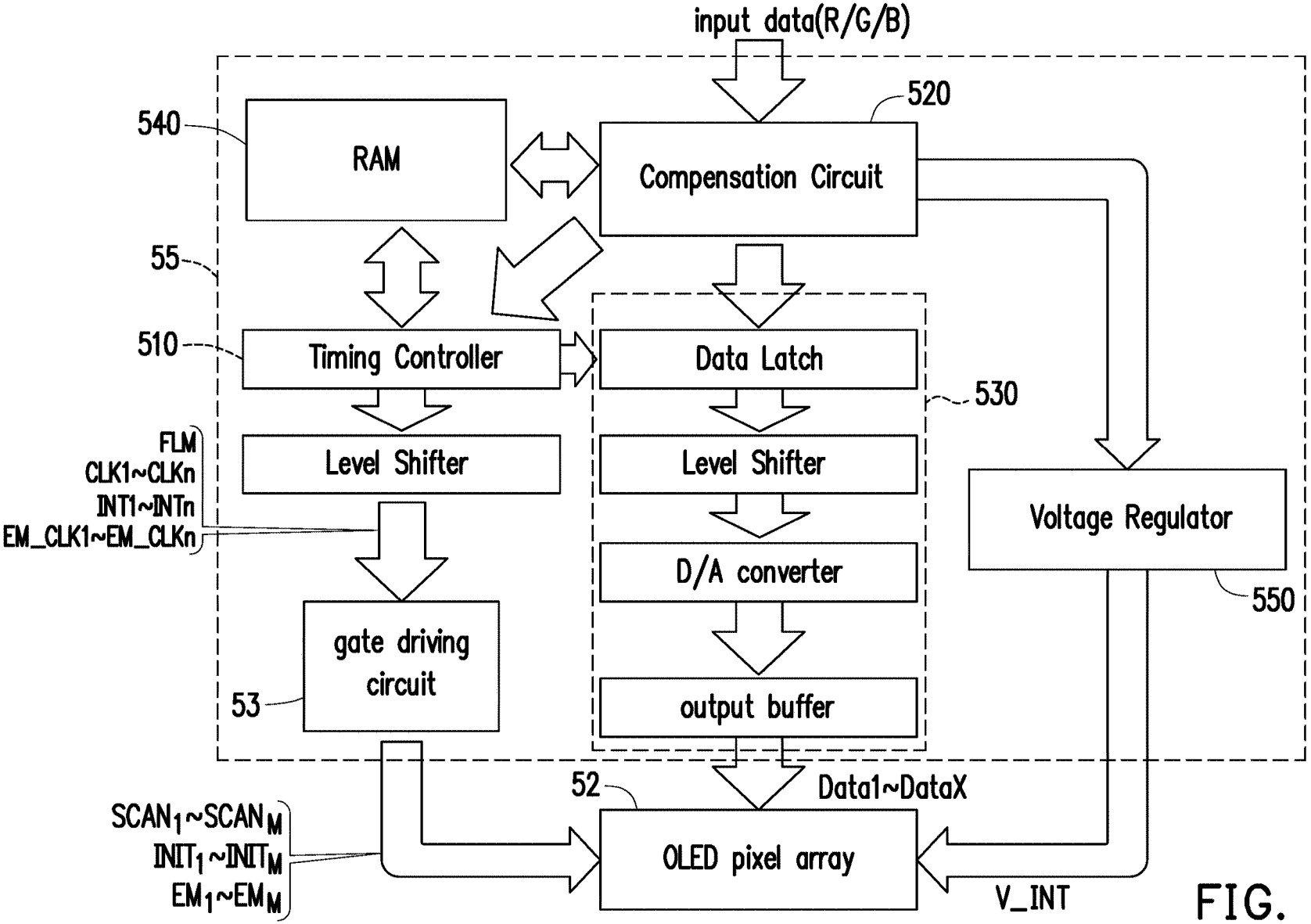
FIG. 23 is a circuit block diagram of a driving apparatus according to an embodiment of the present invention.

The driving apparatus 500 including the data driving circuit 530 and timing control circuit 510 and not including the gate driving circuit may be integrated as a semiconductor chip. In another perspective, the driving apparatus 500 and the gate driving circuit 51 (e.g. GOA) may be regarded as a driving apparatus for driving the OLED pixel array 52. FIG. 23 is a circuit block diagram of a driving apparatus 53 according to an embodiment of the present invention. Referring to FIG. 23 and FIG. 5, the driving apparatus 55 includes the timing control circuit 510, the compensation circuit 520, the data driving circuit 530, the frame memory 540, the voltage regulator 550, and a gate driving circuit 53. The gate driving circuit 53 can be a gate on array (GOA) circuit disposed on the OLED display panel, or be integrated with other circuits (e.g., 510-550) to be a semiconductor chip. By the gray level analysis performed by the compensation circuit 520, the timing control circuit 510 of FIG. 23 can generate gate clock signals CLK1-CLKn and initialization clock signals INT1-INTn as illustrated in anyone of the timing diagrams of FIGS. 10-22 and the voltage regulator 550 of FIG. 23 can generate the initialization voltage as illustrated in FIGS. 19-20. The OLED pixel array 52 includes a plurality of pixel cells, and each pixel cell may be, for example, a p-type OLED pixel circuit of FIG. 2A, or an n-type OLED pixel circuit of FIG. 2B. Take the pixel cell 112*a* of FIG. 2A in the following example. Each pixel cell of the OLED pixel array 52 of FIG. 23 includes the OLED 201 and a first control element, which is the driving TFT T1. The driving TFT T1 determines luminance of the OLED 201 in the emission stage of the pixel cell. The driving TFT T1 has a gate electrode (as a control terminal) coupled to an initialization terminal of the pixel cell. The initialization terminal of the pixel cell is a terminal coupled to the initialization voltage V_INT provided by the driving apparatus 55. As in FIG. 2A, the gate electrode of the driving TFT T1 is coupled to the initialization voltage V_INT via the TFT T2 which is an initialization TFT. It is noted that a p-type pixel cell may have various implementations different from the pixel cell 112*a* of FIG. 2A, and generally a pixel cell includes at least a driving TFT and at least an initialization TFT.

In an embodiment, the voltage regulator 550 of FIG. 23 is coupled to the initialization terminal of the pixel cell and is configured to generate the initialization voltage V_INT to the initialization terminal of the pixel cell in the initialization stage of the pixel cell. During a frame period such as the N-th frame period (where luminance drop occurs in the m-th horizontal line), the voltage regulator 550 is configured to generate a first initialization voltage during a first display period of the N-th frame period to the initialization terminal of a first pixel cell of the OLED pixel array 52, wherein the first pixel cell is in the m-th horizontal line where luminance drop occurs. The first initialization voltage has a voltage level different from a second initialization voltage (e.g., a normal initialization voltage) that voltage regulator 550 generates during a second display period of the N-th frame period to the initialization terminal of a second pixel cell of the OLED pixel array 52. The first initialization voltage is lower than the normal initialization voltage in the case of the OLED pixel cell using p-type TFTs. In an example, the second pixel cell may be in a horizontal line where luminance drop does not occur, and the first display period and the second display period may be two different horizontal line periods of the N-th frame period. In another example, in a case that a horizontal line is divided into pixel cell groups which are respectively provided with the initialization voltage and the gray level analysis is group-by-group performed, the second pixel cell may be also in the m-th horizontal line but belongs to a different group from the first pixel cell belongs, and the first display period and the second display period may be regarded as two different periods of the N-th frame period. Herein, a display period may equals a horizontal line period or be different from (e.g., less than) a horizontal line period.

In the aspect of the OLED display panel including the OLED pixel array 52, the initialization terminal of the first pixel cell is configured to receive the first initialization voltage during the first display period of the N-th frame period, and the initialization terminal of the second pixel cell the configured to receive the second initialization voltage (e.g., the normal initialization voltage) having a voltage level different from the first initialization voltage during the second display period of the N-th frame period.

Referring to FIG. 2A and FIG. 23, the OLED pixel cell further includes an initialization TFT T2 (as a second control element). The gate electrode (control terminal) of the driving TFT (the first control element) is coupled to the initialization TFT. The gate electrode (control terminal) of the initialization TFT is configured to receive a driving control signal and the initialization TFT is configured to establish a connection between the gate electrode of the driving TFT and an initialization terminal of the pixel cell. In an embodiment, the voltage regulator circuit 550 of FIG. 23 is coupled to the initialization terminal of the pixel cell and configured to generate an initialization voltage for the pixel cell in an initialization stage of the pixel cell, and a control circuit, which includes the timing control circuit 510 and the gate driving circuit 53, is coupled to the initialization TFT of the pixel cell and configured to generate a driving control signal for the pixel cell. The driving control signal is an initialization scan signal (INIT) for controlling the initialization TFT to transfer the initialization voltage V_INT to the gate electrode of the driving TFT of the pixel cell. During a frame period such as the N-th frame period (where luminance drop occurs in the m-th horizontal line), the control circuit is configured to generate a first initialization scan signal having a first pulse width (i.e., active pulse width) during a first display period of the N-th frame period, for a first pixel cell of the pixel cells, and generate a second initialization scan signal having a second pulse width different from the first pulse width during a second display period of the N-th frame period, for a second pixel cell of the pixel cells. As the mentioned previously, the first pixel cell and the second pixel cell may be or may be not in the same horizontal line, which is not limited in the embodiment. A display period may equals a horizontal line period or be different from (e.g., less than) a horizontal line period.

In the aspect of the OLED display panel including the OLED pixel array 52, the gate electrode (control terminal) of the initialization TFT (the second control element) of the first pixel cell is configured to receive the first initialization scan signal having the first pulse width during the first display period of the N-th frame period, and the gate electrode of the initialization TFT of the second pixel cell is configured to receive the second initialization scan signal having the second pulse width different from the first pulse width during the second display period of the N-th frame period.

Further Referring to FIG. 2A and FIG. 23. The pixel cell further includes the compensation TFT T4 (as a third control element) and the storage capacitor 202 (as a charge storage element). The gate electrode of the driving TFT is coupled to a first terminal of the storage capacitor 202, and a path is formed between a data input terminal (which receives data voltage Dataj) of the pixel cell and the first terminal of the storage capacitor 202 via the compensation TFT in a data writing and compensation stage. In an embodiment, the data driving circuit 530 of FIG. 23 is coupled to the data input terminal of the pixel cell and configured to generate the data voltage Dataj corresponding to the pixel cell, and a control circuit, which includes the timing control circuit 510 and the gate driving circuit 53, is coupled to the compensation TFT and configured to generate a driving control signal for the pixel cell. The driving control signal is a gate scan signal (SCAN) for controlling the gate electrode of the compensation TFT of the pixel cell to conduct the path in the data writing and compensation stage so as to charge or discharge the charge storage element according to the data voltage generated by the data driving circuit 530. During a frame period such as the N-th frame period (where luminance drop occurs in the m-th horizontal line), the control circuit is configured to generate a first gate scan signal having a first pulse width during a first display period of the N-th frame period, for a first pixel cell of the pixel cells, and generate a second gate scan signal having a second pulse width different from the first pulse width during a second display period of the N-th frame period, for a second pixel cell of the pixel cells. As the mentioned previously, the first pixel cell and the second pixel cell may be or may be not in the same horizontal line, which is not limited in the embodiment. A display period may equals a horizontal line period or be different from (e.g., less than) a horizontal line period.

In the aspect of the OLED display panel including the OLED pixel array 52, the gate electrode (control terminal) of the compensation TFT (the third control element) of the first pixel cell is configured to receive the first gate scan signal having the first pulse width during a first display period of the N-th frame period, and the gate electrode of the compensation TFT of the second pixel cell is configured to receive the second gate scan signal having the second pulse width different from the first pulse width during the second display period of the frame period.

Although the embodiments illustrated in the figures are related to the AMOLED display device, the AMOLED display panel, and associated driving apparatus, the embodiments of the present invention can also be used in the active matrix LED display device, the active matrix LED display panel, and associated driving apparatus. The embodiments of the present invention can be implemented no matter the driving scheme of the OLED display panel (or LED display panel) is. The embodiments of the present invention can be implemented for the OLED display panel using three-stage driving scheme (including the initialization stage, the data writing and compensation stage, and the emission stage), or for the OLED display panel using two-stage driving scheme (including the initialization stage and a stage in combination of data writing/compensation and emission). Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A driving apparatus of a light emitting diode (LED) display device, comprising:

a timing control circuit, outputting a plurality of driving control signals to a gate driving circuit on an LED display panel of the LED display device, wherein the plurality of driving control signals comprises a first driving control signal and a second driving control signal, and in response to a gray level difference between image data corresponding to a target horizontal line in a first frame and image data corresponding to the target horizontal line in a second frame preceding to the first frame being determined to be greater than a threshold value, the pulse width of the first driving control signal in a first horizontal line period is configured to be different from the pulse width of a second driving control signal in a second horizontal line period preceding to the first horizontal line period.

2. The driving apparatus according to claim 1, wherein the plurality of driving control signals comprises at least two gate clock signals or at least two initialization clock signals.

3. The driving apparatus according to claim 1, wherein the first horizontal line period and the second horizontal line period are configured to be of the same period length, and the pulse width of the first driving control signal is configured to be less than the pulse width of the second driving control signal.

4. The driving apparatus according to claim 1, wherein the period length of the first horizontal line period is configured to be greater than a normal period length, and the pulse width of the first driving control signal is configured to be greater than the pulse width of the second driving control signal.

5. The driving apparatus according to claim 1, wherein the plurality of driving control signals are gate clock signals, and the first horizontal line period is a period during which the image data corresponding to the target horizontal line in the first frame are output to the target horizontal line.

6. The driving apparatus according to claim 1, wherein the plurality of driving control signals are initialization clock signals and the first horizontal line period is preceding to a horizontal line period during which the image data corresponding to the target horizontal line in the first frame are output to the target horizontal line.

7. The driving apparatus according to claim 1, wherein the pulse width of each of the plurality of driving control signals in a first duration, which is from the first horizontal line period to a third horizontal line period later than the first horizontal line period, is configured to be different from the pulse width of the second driving control signal in the second horizontal line period.

8. A driving apparatus of a light emitting diode (LED) display device, comprising:

a voltage regulator circuit, outputting an initialization voltage to the LED display panel of the LED display device, wherein in response to a gray level difference between image data corresponding to a target horizontal line in a first frame and image data corresponding to the target horizontal line in a second frame preceding to the first frame being determined to be greater than a threshold value, the initialization voltage is configured to have a first voltage level in at least a first horizontal line period, and wherein the first voltage level is different from a second voltage level that the initialization voltage is configured to have in a second horizontal line period preceding to the first horizontal line period.

9. The driving apparatus according to claim 8, wherein the initialization voltage is configured to have the first voltage level lasting for a predetermined length in the first horizontal line period, and wherein the predetermined length is determined according to the pulse width of an initialization clock signal in the first horizontal line period.

10. The driving apparatus according to claim 8, wherein the initialization voltage is configured to have the first voltage level lasting for a predetermined length longer than the first horizontal line period.

11. The driving apparatus according to claim 8, wherein the first horizontal line period is preceding to a horizontal line period during which the image data corresponding to the target horizontal line in the first frame are output to the target horizontal line.

* * * * *